US006742484B2

(12) United States Patent
Sluka et al.

(10) Patent No.: US 6,742,484 B2
(45) Date of Patent: Jun. 1, 2004

(54) DEVICE FOR RELATIVE ROTATIONAL ANGLE ADJUSTMENT OF A CAM SHAFT OF AN INTERNAL COMBUSTION ENGINE TO A DRIVE WHEEL

(75) Inventors: Gerold Sluka, Neckartaiflingen (DE); Edwin Palesch, Lenningen (DE); Andreas Knecht, Kusterdingen (DE); Wolfgang Stephan, Boll (DE)

(73) Assignees: Ing. h.c.F. Porsche AG, Stuttgart (DE); Hydraulik Ring GmbH, Automobiltechnik, Limbach-Oberfrohna (DE)

( * ) Notice: Subject to any disclaimer, the term of this patent is extended or adjusted under 35 U.S.C. 154(b) by 0 days.

(21) Appl. No.: 09/882,380

(22) Filed: Jun. 18, 2001

(65) Prior Publication Data

US 2002/0020375 A1 Feb. 21, 2002

(30) Foreign Application Priority Data

Jun. 16, 2000 (DE) ..... 100 29 798
Jan. 13, 2001 (DE) ..... 101 01 328

(51) Int. Cl.[7] ..... F01L 1/34

(52) U.S. Cl. ..... 123/90.17; 123/90.15; 74/568 R

(58) Field of Search ..... 123/90.17, 90.15, 123/90.16, 90.12, 90.31; 74/568 R; 464/1, 2, 160; 92/121, 122

(56) References Cited

U.S. PATENT DOCUMENTS 5,924,395 A * 7/1999 Moriya et al. ..... 123/90.15
5,937,808 A 8/1999 Kako et al.
5,957,095 A 9/1999 Kako
5,960,757 A * 10/1999 Ushida ..... 123/90.17
6,230,675 B1 * 5/2001 Kobayashi et al. ..... 123/90.15
6,276,322 B1 * 8/2001 Sekiya et al. ..... 123/90.17

FOREIGN PATENT DOCUMENTS

| | | |
|---|---|---|
| DE | 196 23 818 | 12/1996 |
| EP | 0892155 | 1/1999 |
| EP | 0916813 | 5/1999 |
| EP | 1008729 | 6/2000 |
| EP | 1 008 729 | 6/2000 |

* cited by examiner

*Primary Examiner*—Thomas Denion
*Assistant Examiner*—Jaime Corrigan
(74) *Attorney, Agent, or Firm*—Crowell & Moring LLP

(57) ABSTRACT

At least one locking device between an interior part and cellular wheel, which is equipped with a movable locking element that acts together with at least one counter-element in a respectively other component of the two components cellular wheel or interior part, causes the interior part to be able to be locked relative to the cellular wheel in at least one final position. The locking and/or unlocking process of the locking element occurs through at least one oil duct that leads to the locking element. Between two pressure chambers in or on the cellular wheel an opening connected with the oil duct is arranged, whose passage to the two pressure chambers is controlled in dependence on the adjusting position of the interior part. This way, the cam shaft adjusting unit can be locked safely.

20 Claims, 24 Drawing Sheets

DEVICE FOR RELATIVE ROTATIONAL ANGLE ADJUSTMENT OF A CAM SHAFT OF AN INTERNAL COMBUSTION ENGINE TO A DRIVE WHEEL

BACKGROUND AND SUMMARY OF THE INVENTION

This invention claims the priority of foreign Applications Nos 100 29 798.6 and 101 01 328.0 filed in Germany on Jun. 16, 2000 and Jan. 13, 2001, respectively, the disclosures of which are expressly incorporated by reference herein.

The invention relates to a device for the relative rotational angle adjustment of a camshaft of an internal combustion engine to a drive wheel with an interior part that is connected in a stationary manner with the cam shaft and equipped with at least roughly radially running ribs or fins, and with a driven cellular wheel, which is equipped with several cells that are distributed across the circumference and limited by ribs, with these cells being divided into two pressure chambers by the ribs or fins of the interior part, which are guided in an articulating manner, and with the cam shaft being adjustable through the ribs or fins between two final positions relative to the cellular wheel when hydraulic pressure is applied and/or relieved through control lines, and with at least one locking device between the interior part and cellular wheel, which is equipped with a movable locking element that acts together with at least one counter-element in the respectively other component of the two components cellular wheel or interior part, causing the interior part to be able to be locked compared to the cellular wheel in at least one final position, with the locking and/or unlocking process of the locking element occurring through at least one oil duct that leads to the locking element.

In German Patent Document 196 23 818 A1, a similar device of the above-mentioned type is known where, with the help of a locking element that is arranged in the rotor of the camshaft adjusting device, this cam shaft adjusting device can be locked in its final position. The locking element can be transferred from its locking position into an unlocked position through oil lines that lead to the locking element. When the cam shaft adjusting device is unlocked, the timing of the intake and exhaust valves of a cam shaft can be changed as desired through the hydraulic adjustment of the rotor relative to the drive wheel of the cam shaft. Due to the cams that are arranged on the cam shaft, which open and close the intake and exhaust valves through appropriate cam followers, such as cup tappet pin, alternating moments (catching—trailing cams) are transferred to the rotor of the cam shaft adjusting device because it is firmly connected with the cam shaft in a stationary manner. These alternating moments, which are caused by the cam shaft, lead to periodic position changes of the rotor compared to the stator of the cam shaft adjusting device, which lead to an undesirable change in the intake and/or exhaust times of the cam shaft in certain operating states of the internal combustion engine, particularly in idle operation, when the locking element has already been unlocked. Furthermore, there is a risk when switching off the internal combustion engine that due to the oil pressure which still remains on the locking element the locking element of the cam shaft adjusting device cannot be locked.

An object of the invention therefore is to improve a device of this kind for the relative rotational angle adjustment of a cam shaft to its drive wheel so as to ensure a secure and reliable locking process of the cam shaft adjusting device through the locking element despite certain operating states in which the adjusting unit may no longer or not yet be active.

This object is achieved in certain preferred embodiments of the invention wherein between two pressure chambers in or on the cellular wheel an opening that is connected with the oil duct is arranged, whose passage to the two pressure chambers is controlled in dependence of the adjusting position of the interior part.

Through an opening, which is arranged between two pressure chambers of a cellular wheel, connected with an oil duct in the rotor for unlocking the locking element and whose cross-section is controlled in dependence of the rotational position of the rotor, first the locking element can be unlocked with the one pressure chamber, while with a second change in the rotor's rotational position—particularly when caused by the alternating moments of the cam shaft—the oil duct can be relieved hydraulically with the other pressure chamber so that the locking element can be changed back safely into the locked position. Also when turning off the internal combustion engine, the oil duct that leads to the locking element is hydraulically relieved with the help of the opening, which ensures that even in the stopped position of the internal combustion engine the locking element is locked again.

Further benefits and beneficial developments of the invention result from the sub-claims and the description.

Other objects, advantages and novel features of the present invention will become apparent from the following detailed description of the invention when considered in conjunction with the accompanying drawings.

DETAILED DESCRIPTION OF THE DRAWINGS

Figure 1:
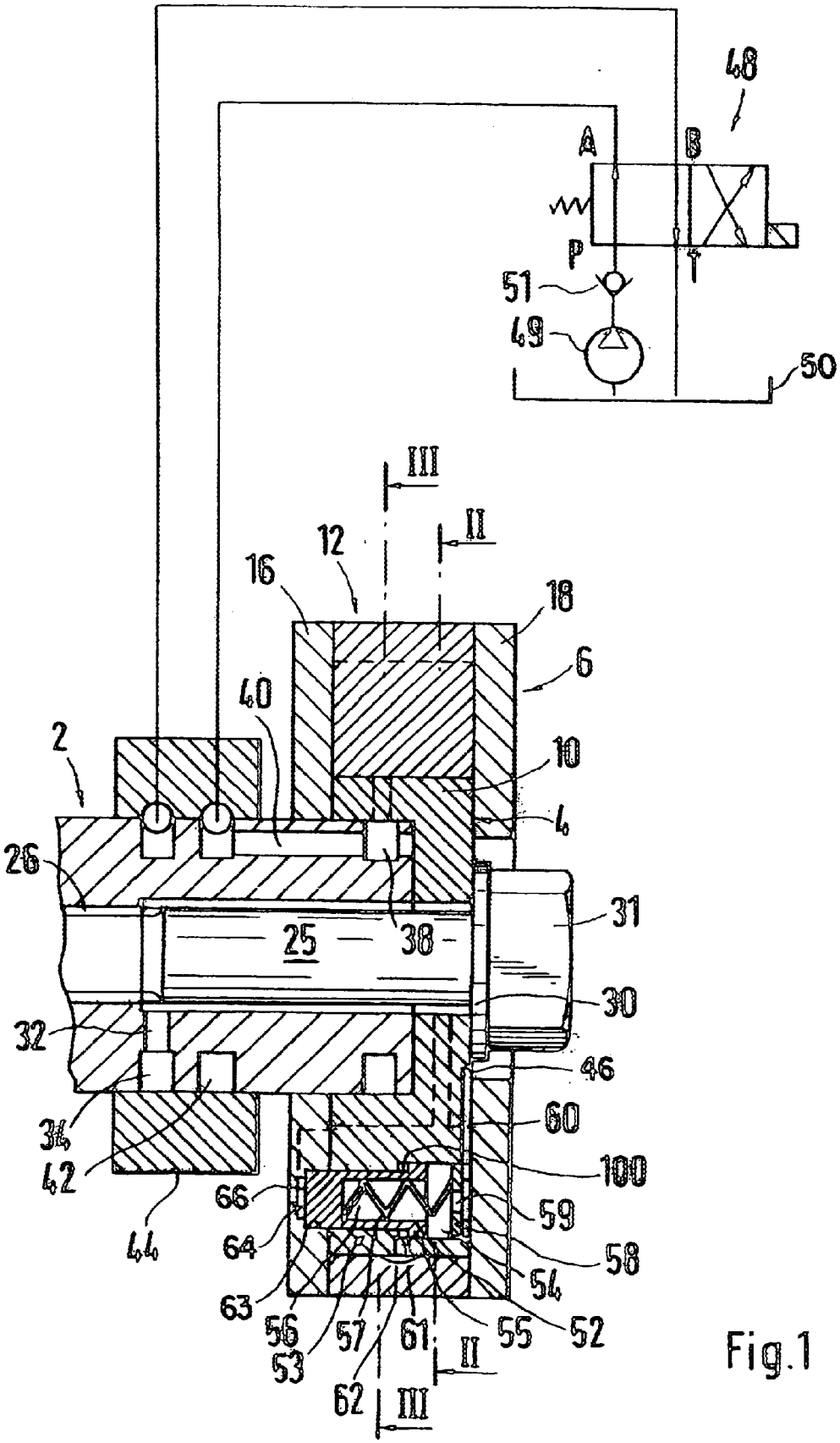
FIG. 1 shows a longitudinal section through the adjusting unit.

In FIGS. 1–4, the cam shaft (2) of the internal combustion engine is indicated in diagrammatic view, with the rotor—marked in the following as interior part 4—of an adjusting device 6 being arranged on the cam shaft's free end in a stationary manner. The interior part 4 in this embodiment is equipped with five radially arranged ribs 8*a* through 8*e*, which extend from a hub 10 of the interior part 4. The rib 8*a* is equipped with two control edges 9*a* and 9*b* on its side surfaces, whose function will be explained further below. The interior part 4 is surrounded by a cellular wheel 12 in the area of its ribs 8*a* through 8*e*, which is equipped with five radially inward protruding ribs 14*a* through 14*e*.

The drive wheel (not shown), which has the design of e.g. a sprocket or toothed belt wheel, is arranged on the outer circumference of the cellular wheel 12 for driving the cam shaft 2. The cellular wheel 12 representing the stator of the adjusting unit 6 is closed off on the front facing the cam shaft 2 with a disk 16, which is guided on the hub 10 of the interior part 4 in a rotating and sealing manner. The opposite front of the cellular wheel 12 is also closed off by a disk 18, wherein the disks 16 and 18 and the cellular wheel 12 are firmly connected with each other by screws (not shown). The passages 20 provided in the ribs 14*a* through 14*e* in the cellular wheel 12 serve the purpose of holding and/or guiding these fastening screws.

The ribs 14*a* through 14*e* of the cellular wheel 12 form five cells, which are limited in the axial direction by the disks 16 and 18 and which are divided by the rotors or ribs 8*a* through 8*e* of the interior part 4 into two pressure chambers 22*a* through 22*e* and/or 24*a* through 24*e*, respectively. The interior part 4 and the articulating cellular wheel 12 are connected with each other by a screw 25. For this, the hub 10 is equipped with a threaded central bore 26.

The pressure chambers 22*a* through 22*e* are connected with an annular chamber 30 through a radial bore 28*a* through 28*e* in the hub 10 of the interior part 4, with this chamber 30 being formed between the fastening screw 25 for the adjusting device 6 and the wall sections of the central bore 26 that is provided in the hub 10, wherein the annular chamber 30 is closed off on its ends by the head 31 of the screw 25.

The annular chamber 30 is connected with an annular groove 34 on the outer circumference of the cam shaft 2 through several bores 32 that are placed radially into the cam shaft 2. The pressure chambers 24*a* through 24*e* are connected with an annular groove 38 on the outer circumference of the cam shaft 2 through radial bores 36*a* through 36*e*, with this groove 38 leading to another annular groove 42, also on the outer circumference of the cam shaft 2, through a bore 40 that is arranged axially in the cam shaft 2.

The two annular grooves 34 and 42, respectively, are connected with a control line A and B through a cam shaft bearing 44 that operates as a rotational through-guide. The two control lines A and B are connected with a control valve 48, which for example has the design of a 4/2 proportional control valve. This control valve 48 is connected with a pressure pump 49 and an oil tank 50. A return valve 51 is arranged directly behind the pressure pump 49 in the pressure line P. In a certain preferred embodiment, the adjusting unit 6 is provided for adjusting an exhaust cam shaft in the final position shown in FIGS. 1–3, wherein the cellular wheel 12 is driven counter-clockwise, while the interior part 4 can be adjusted clockwise in the direction of the "late" opening of the exhaust valves.

Figure 3:
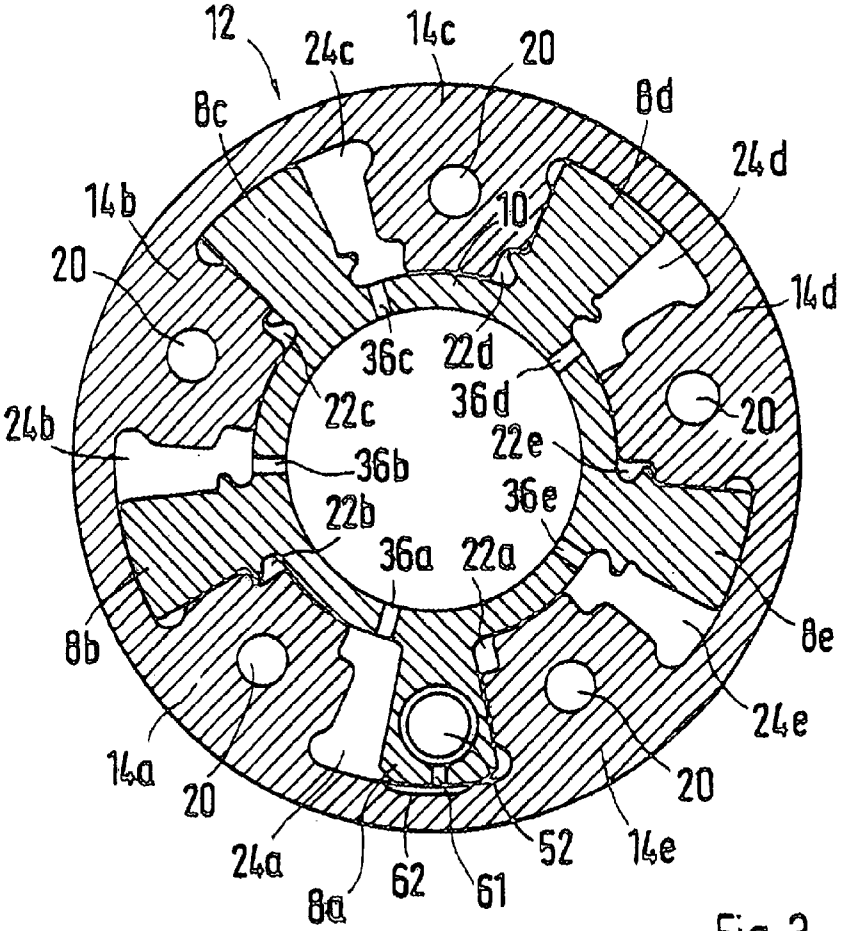
FIG. 3 shows a section along the line III—III in FIG. 1.
Figure 2:
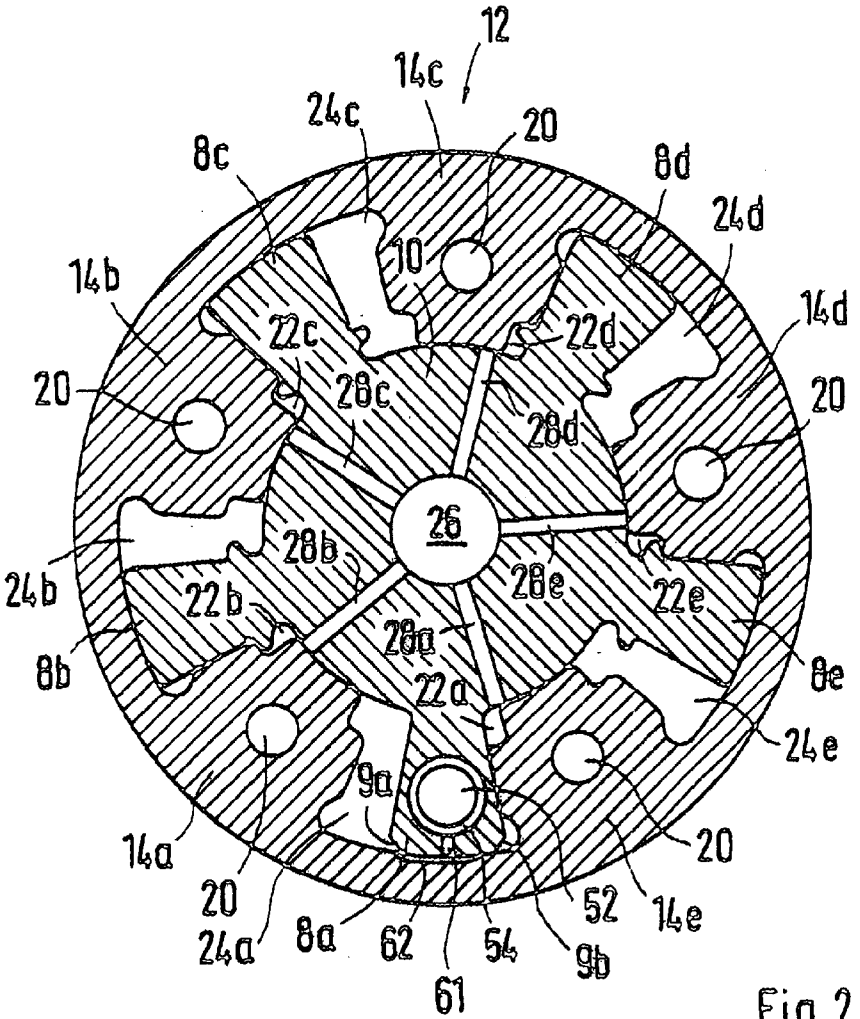
FIG. 2 shows a section along the line II—II in FIG. 1.
Figure 4:
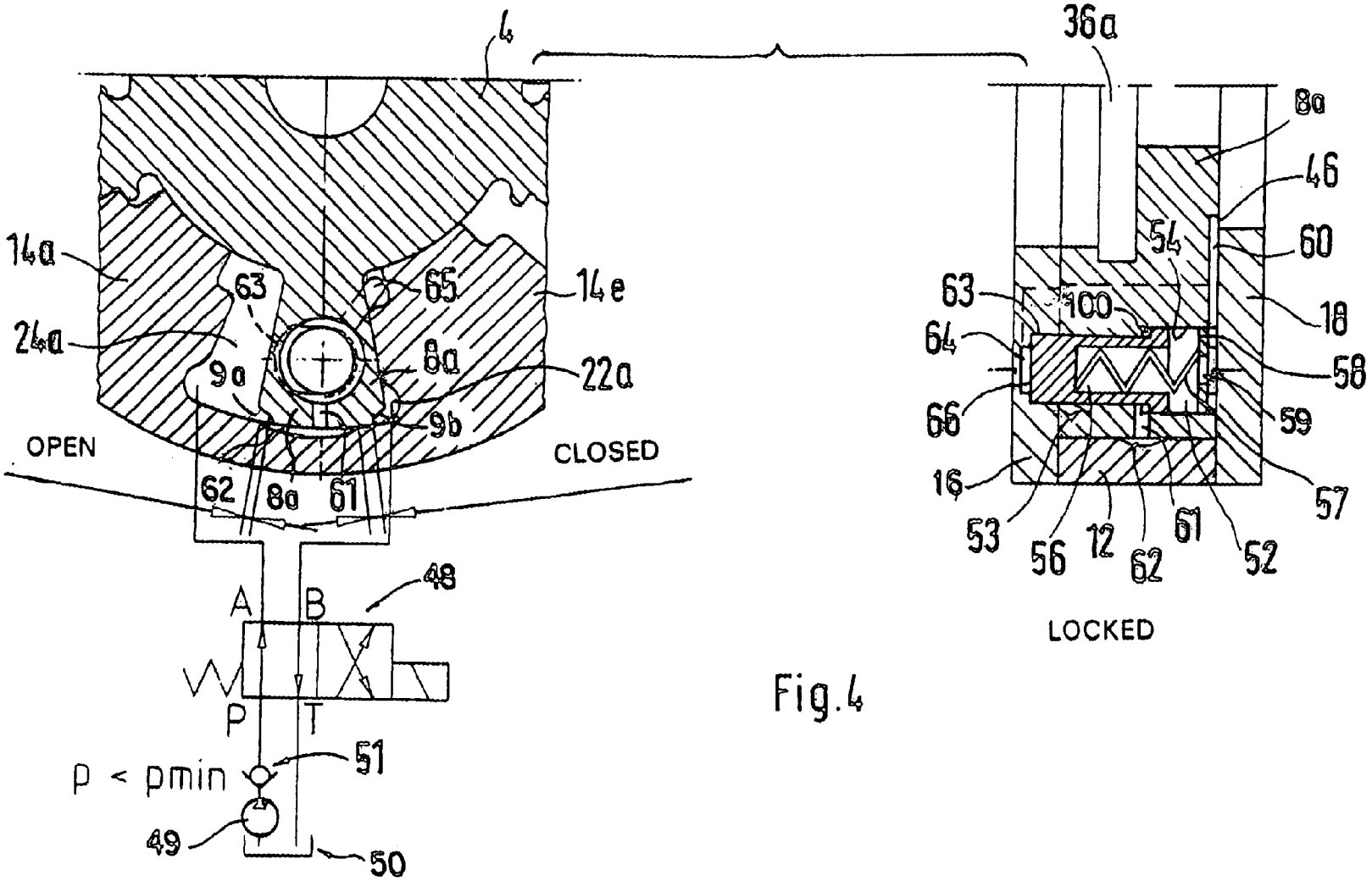
FIG. 4–FIG. 9 show various operating states of the adjusting unit in adjusting direction.
Figure 5:
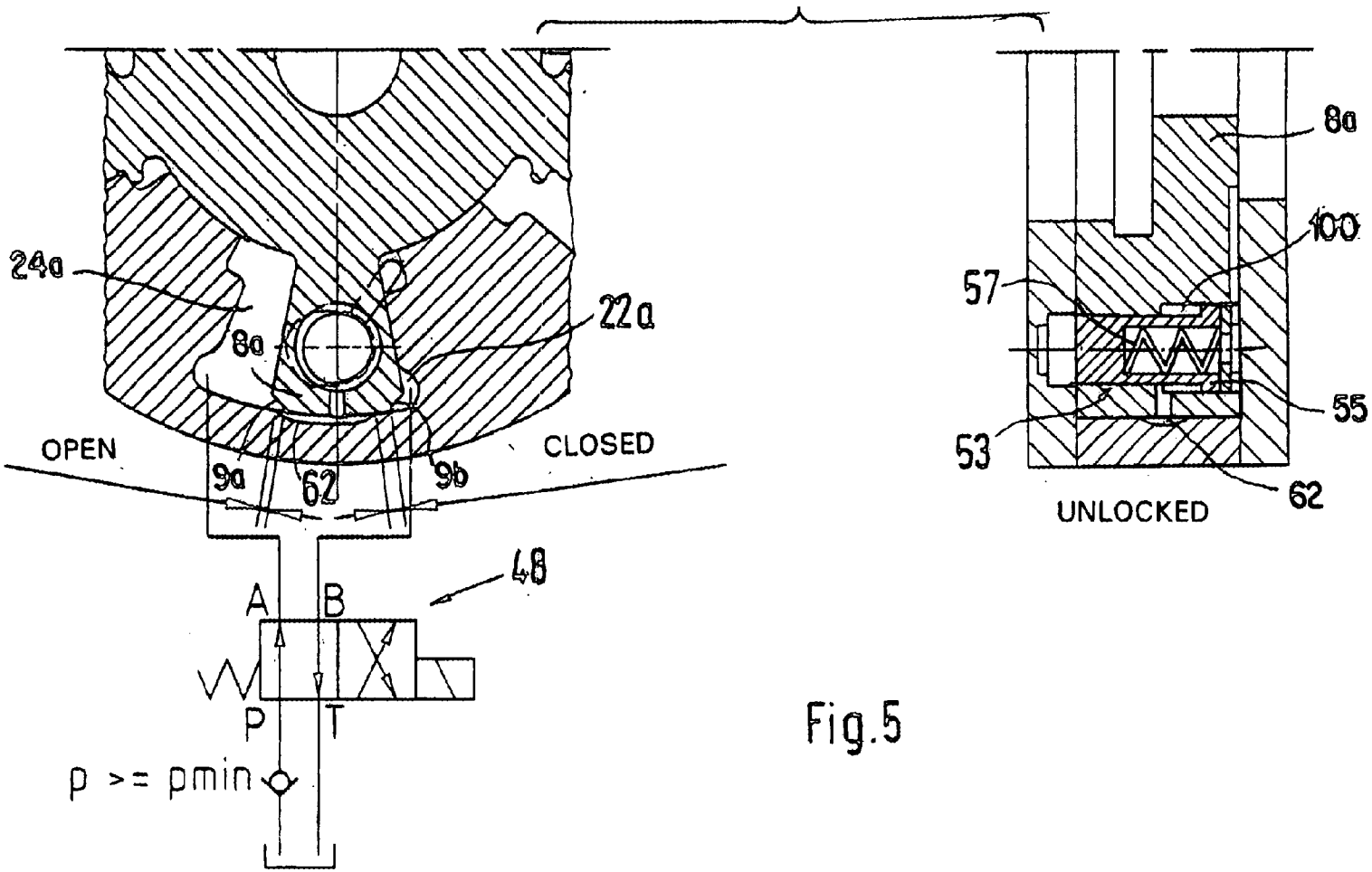
Figure 6:
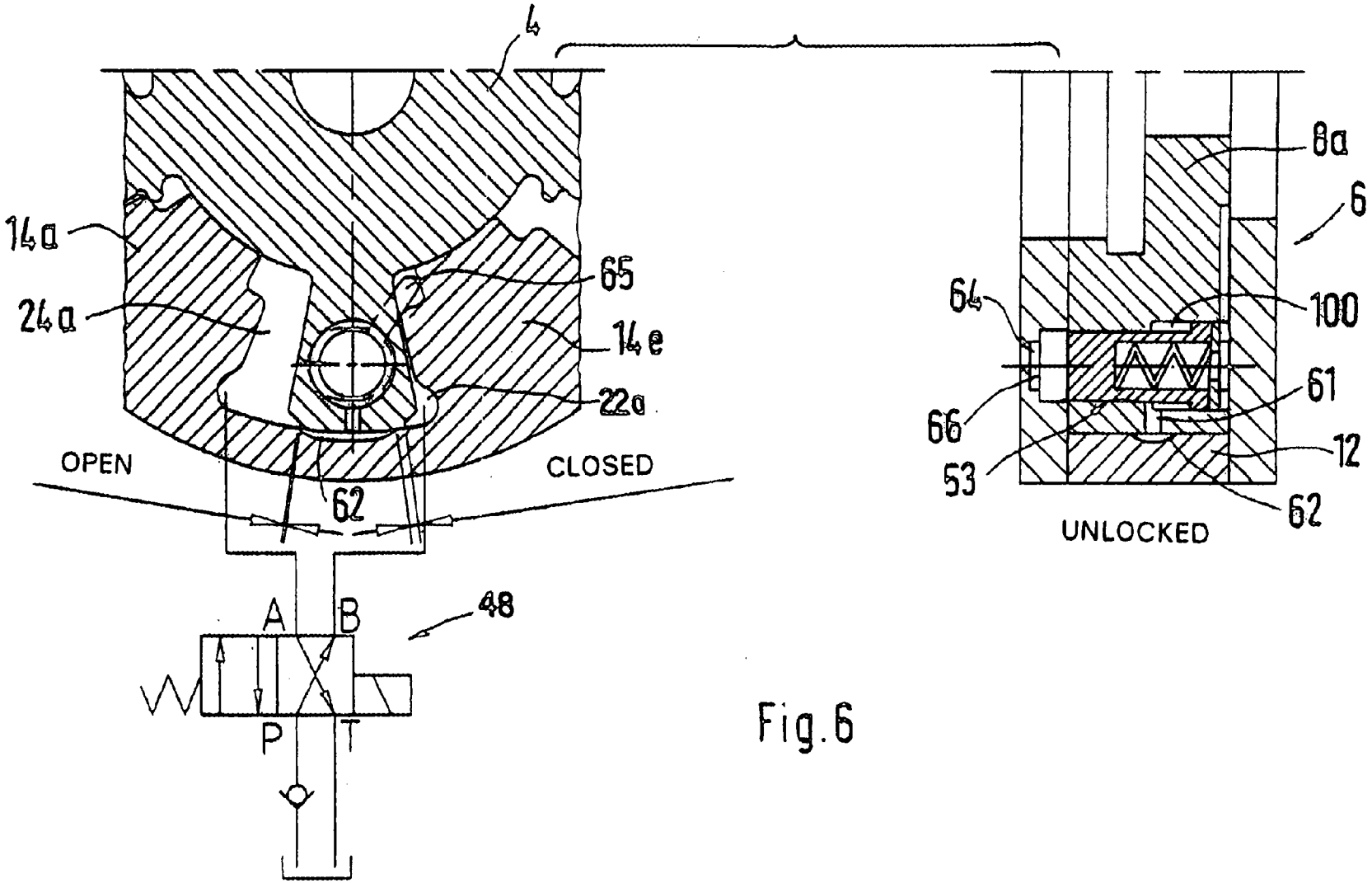
Figure 7:
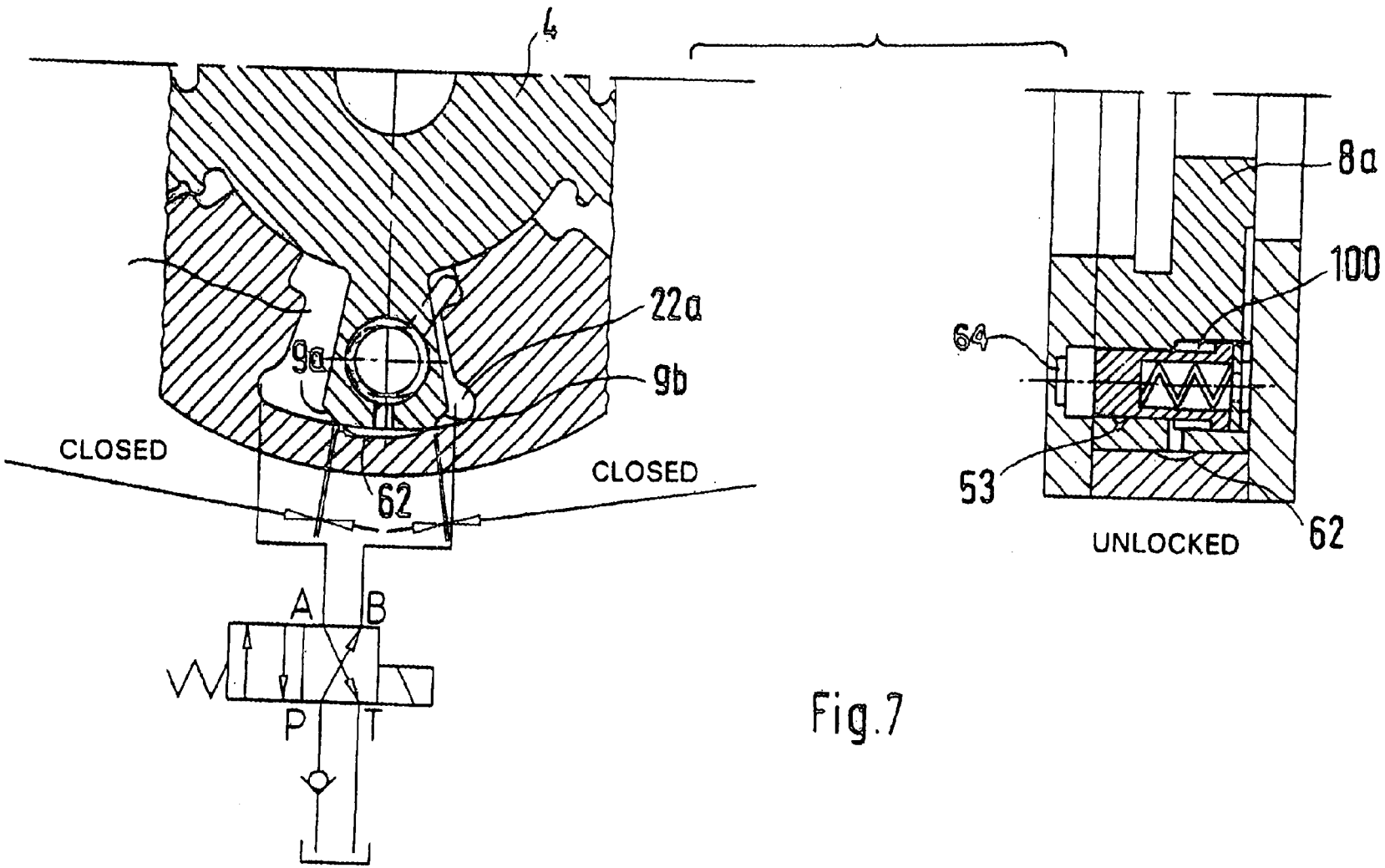
Figure 8:
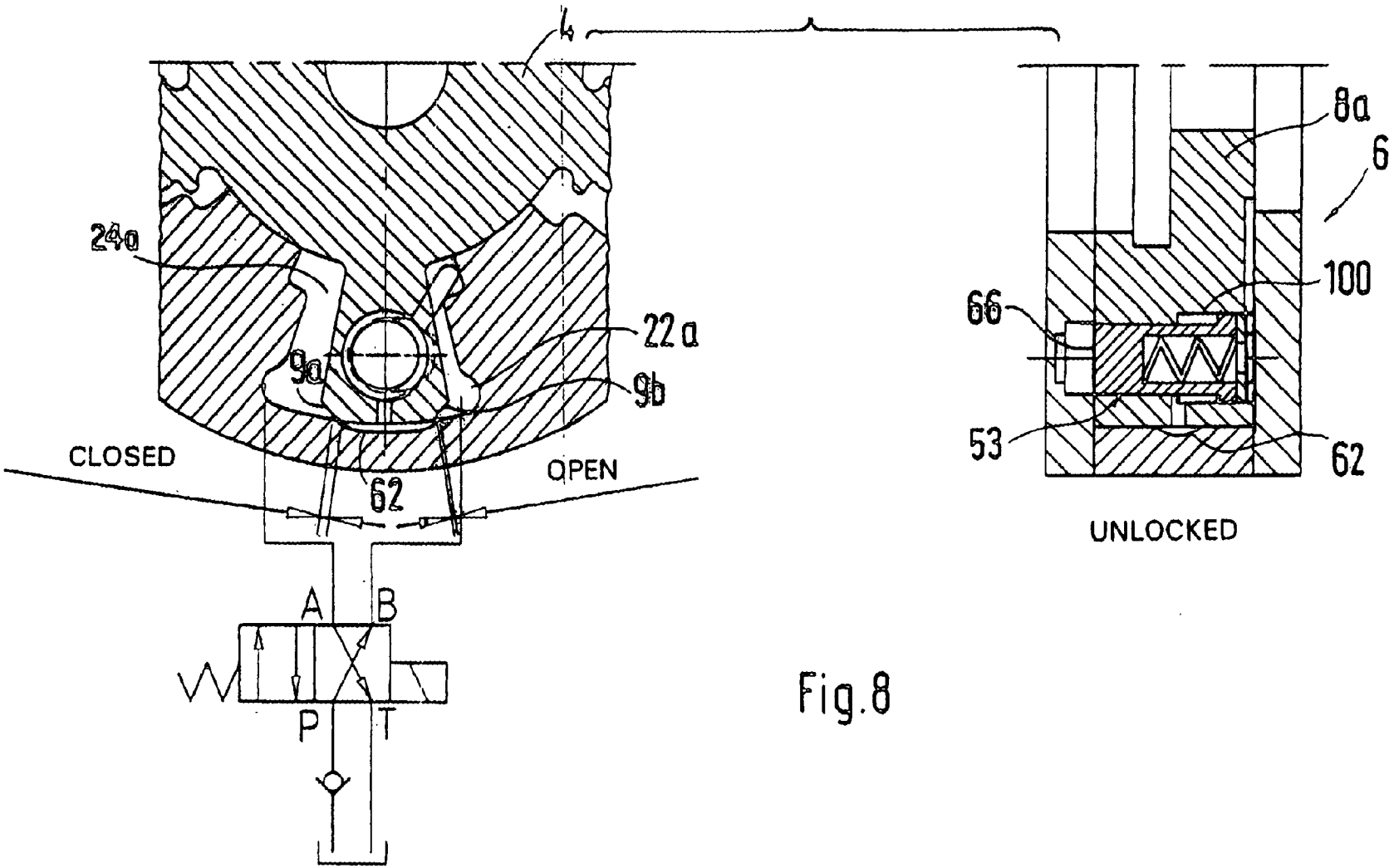
Figure 9:
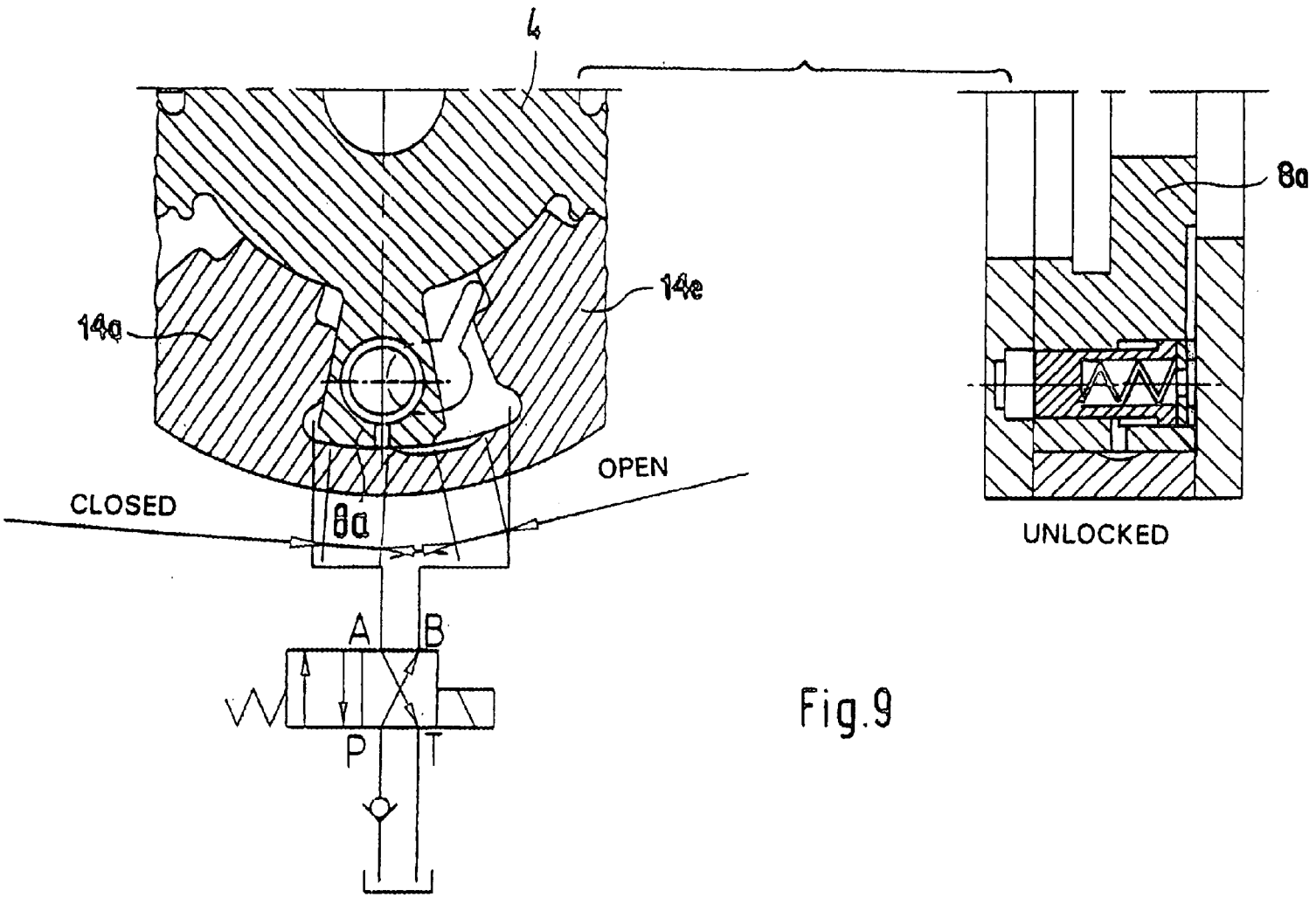
Figure 10:
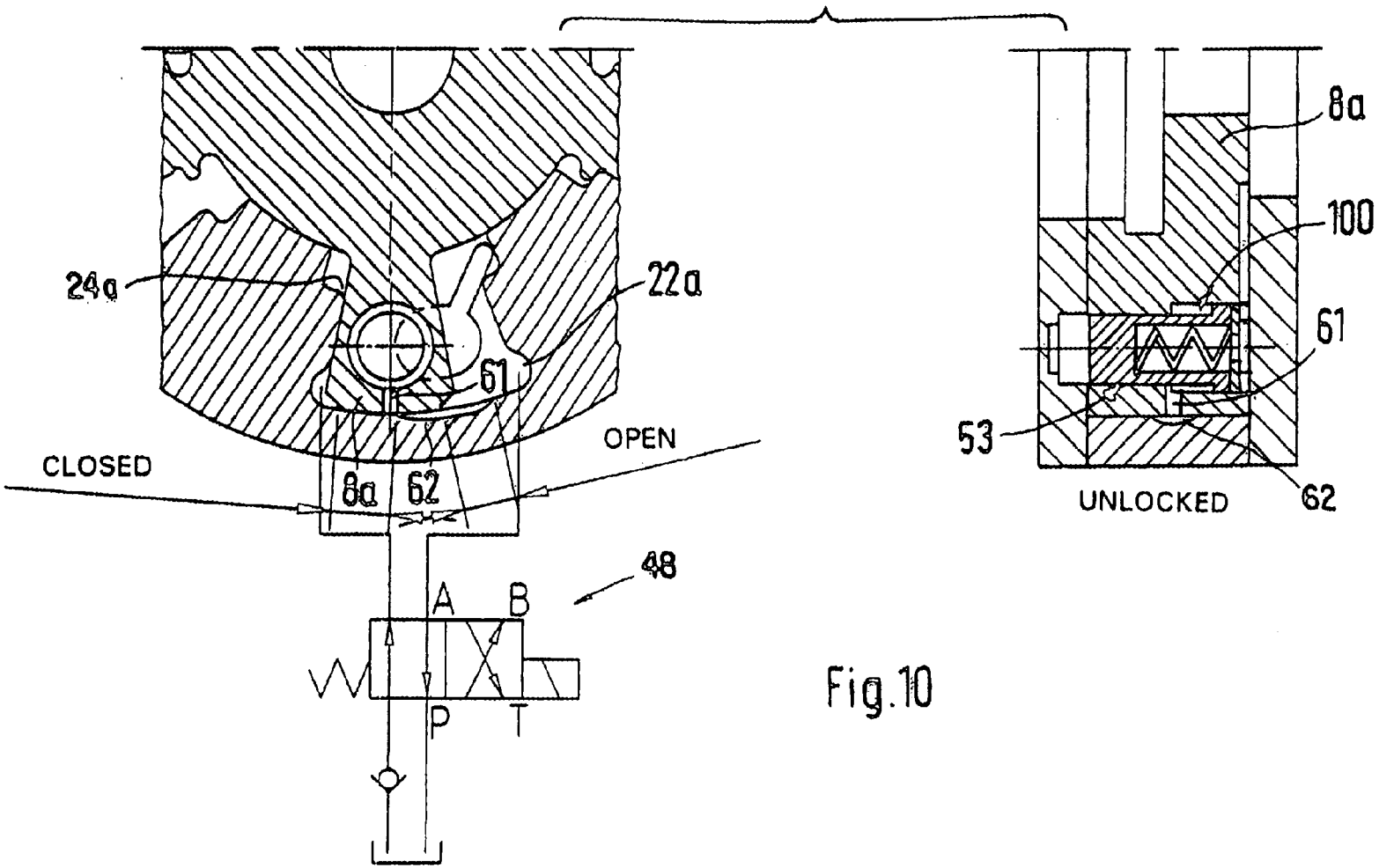
FIG. 10–FIG. 14 show various operating states of the adjusting unit in resetting direction.
Figure 11:
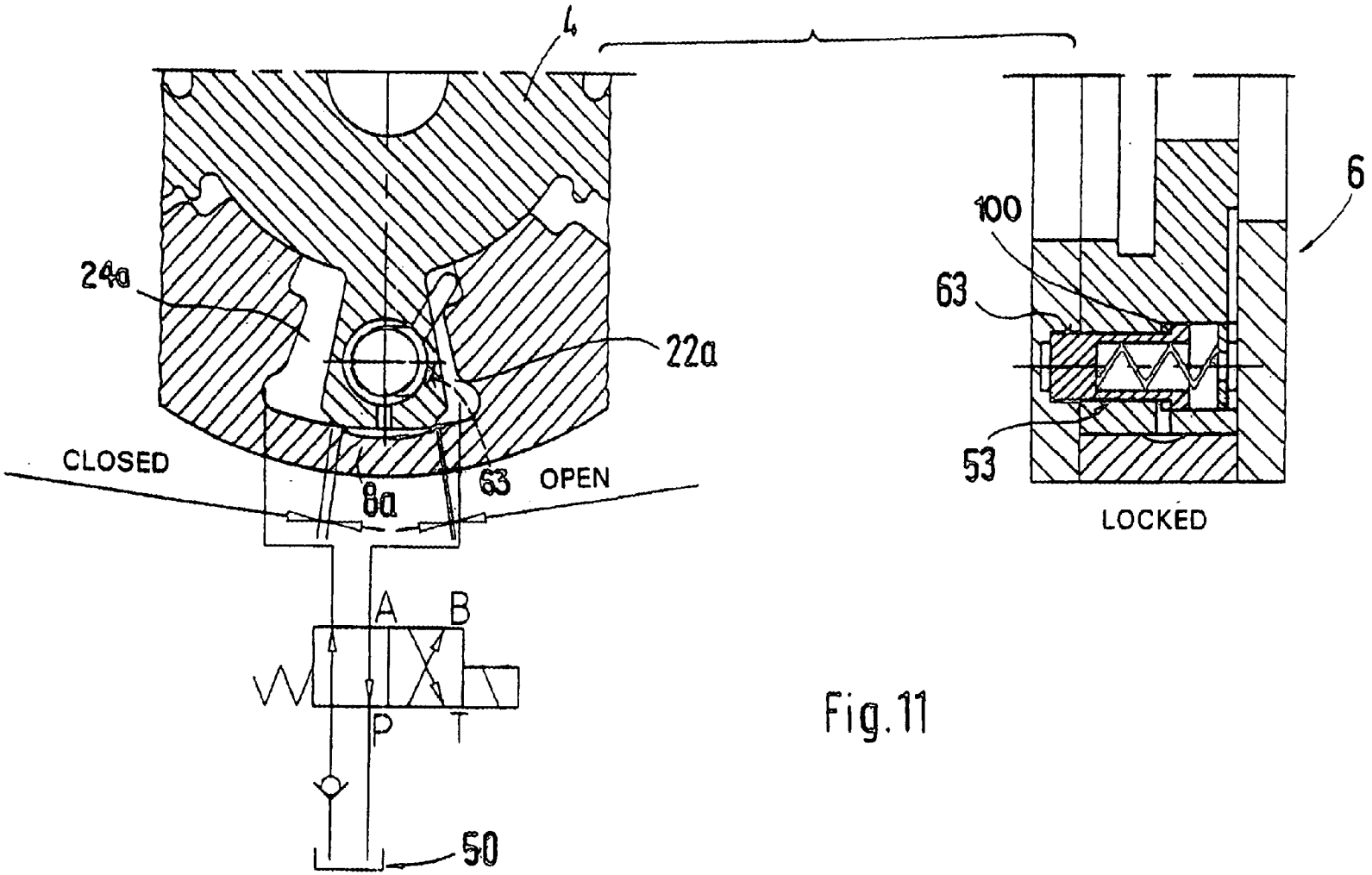
Figure 12:
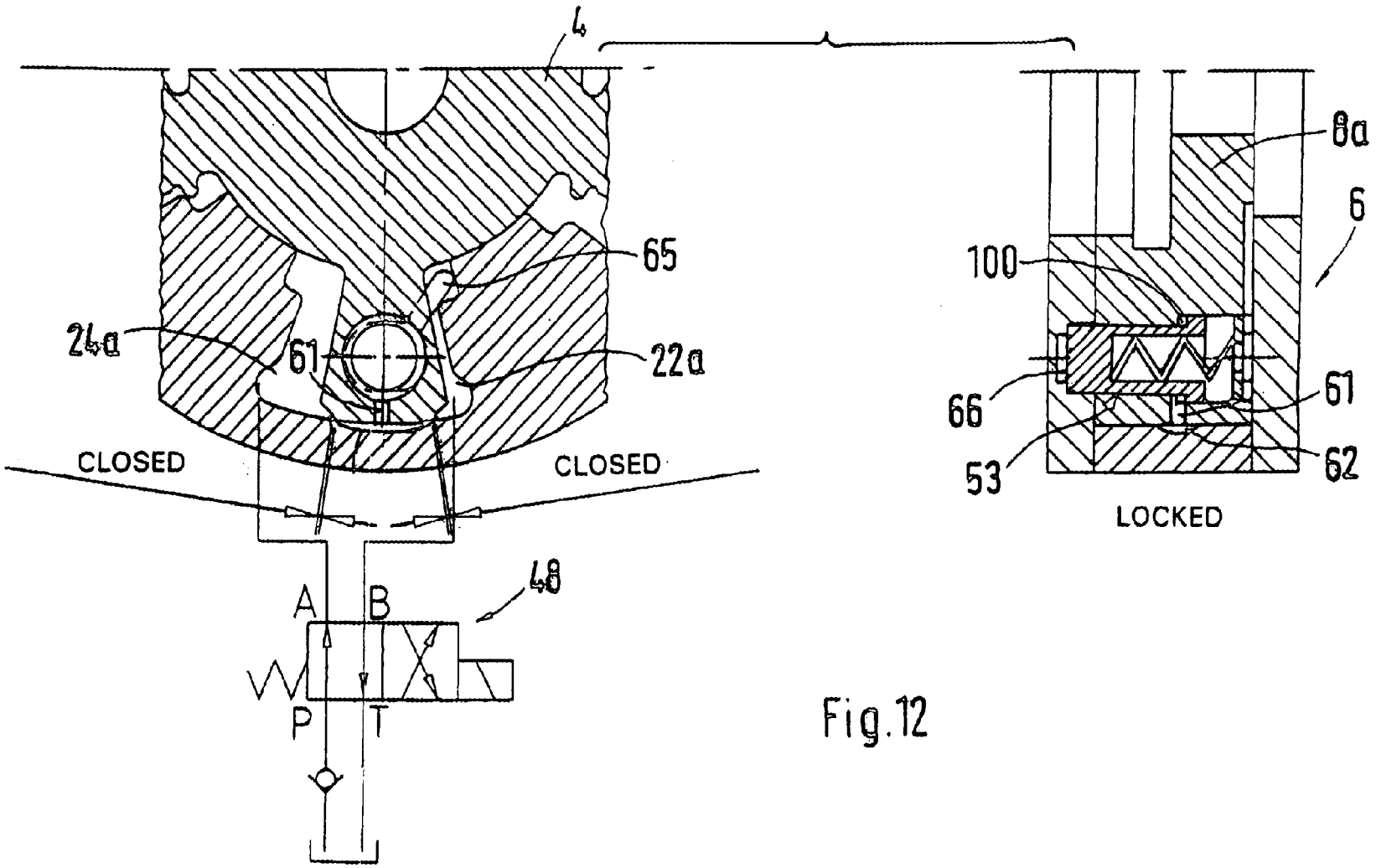
Figure 13:
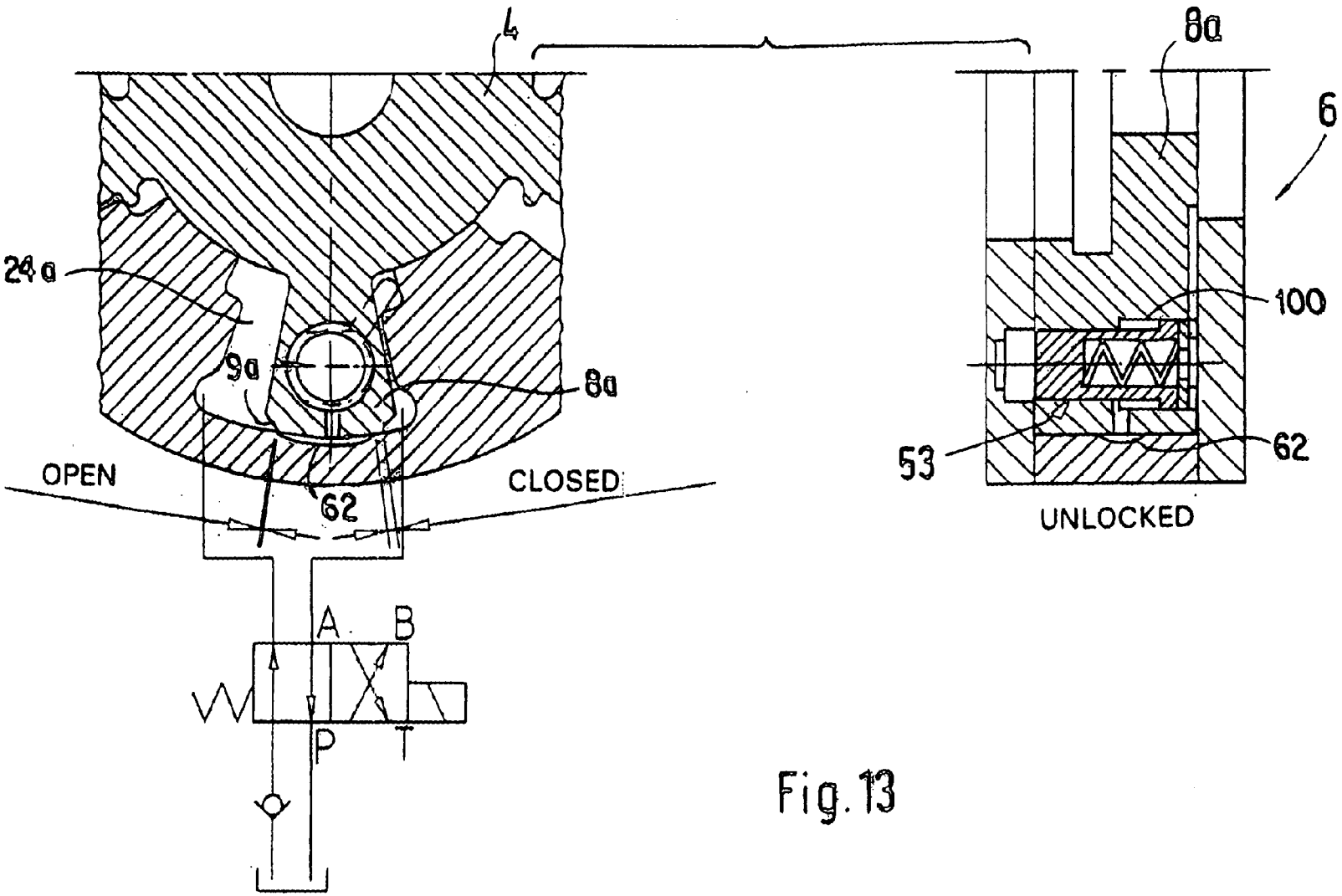
Figure 14:
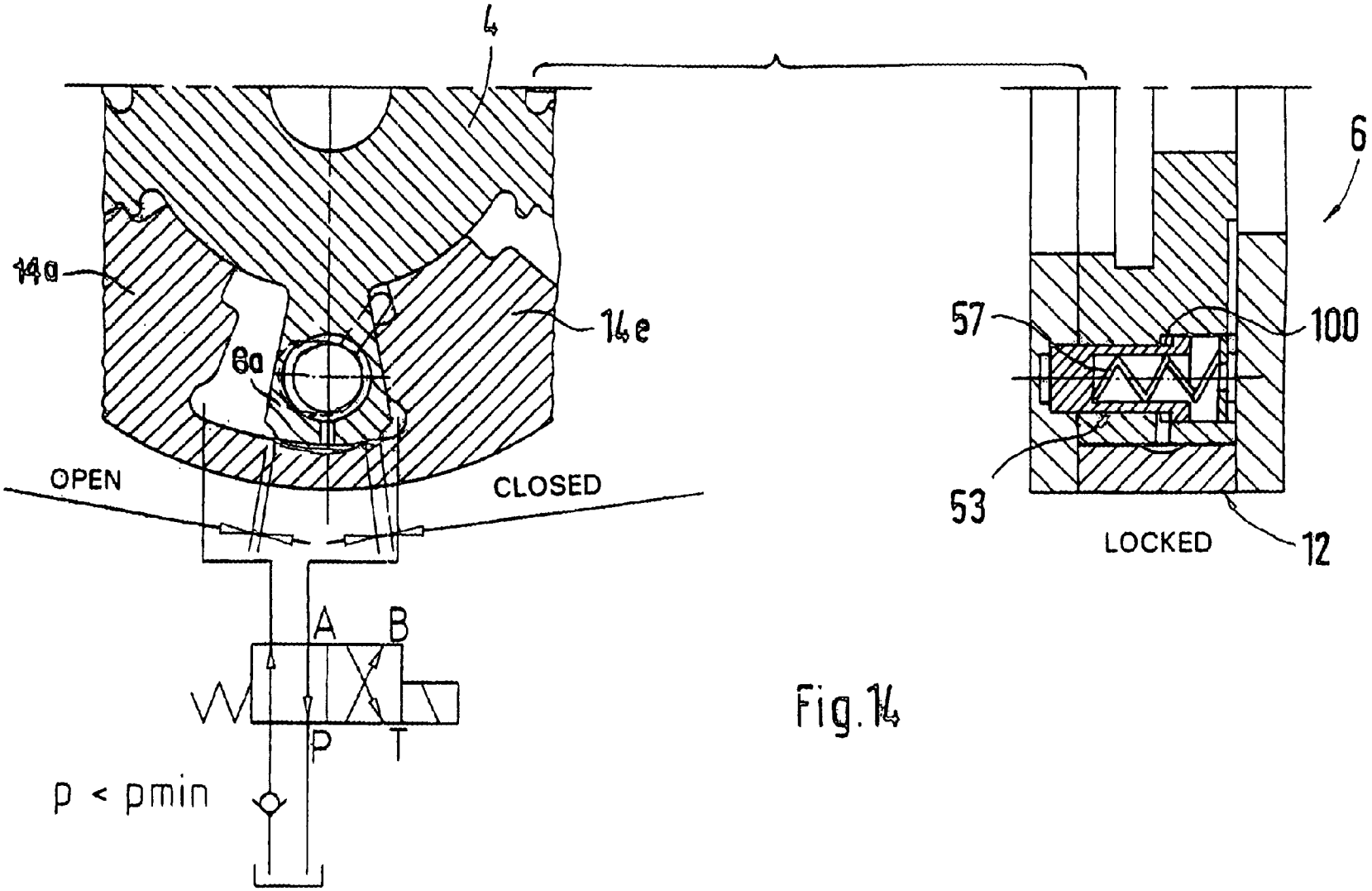
Figure 15:
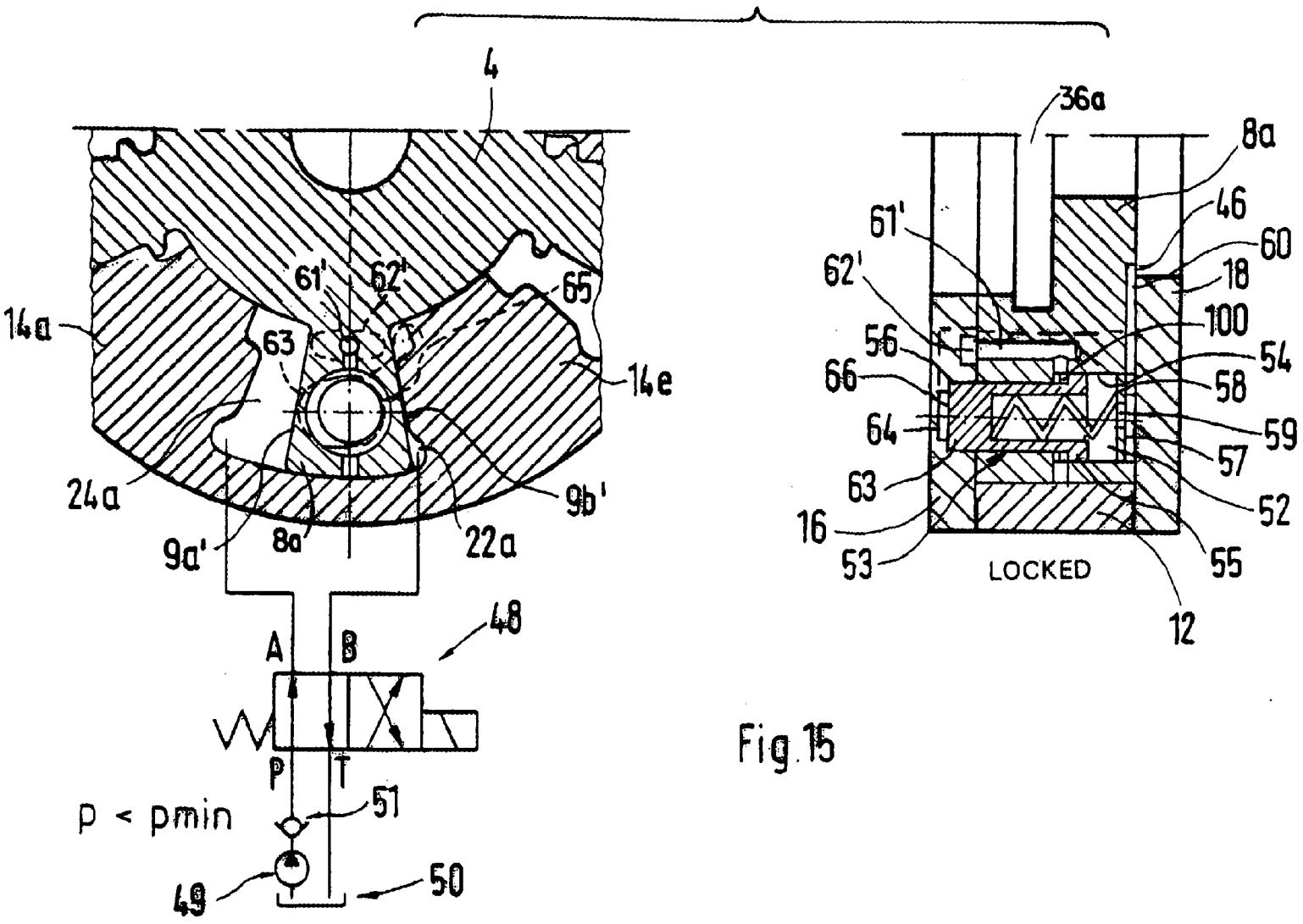
FIG. 15–FIG. 20 show various operating states of the adjusting unit in adjusting direction based on a second embodiment.
Figure 16:
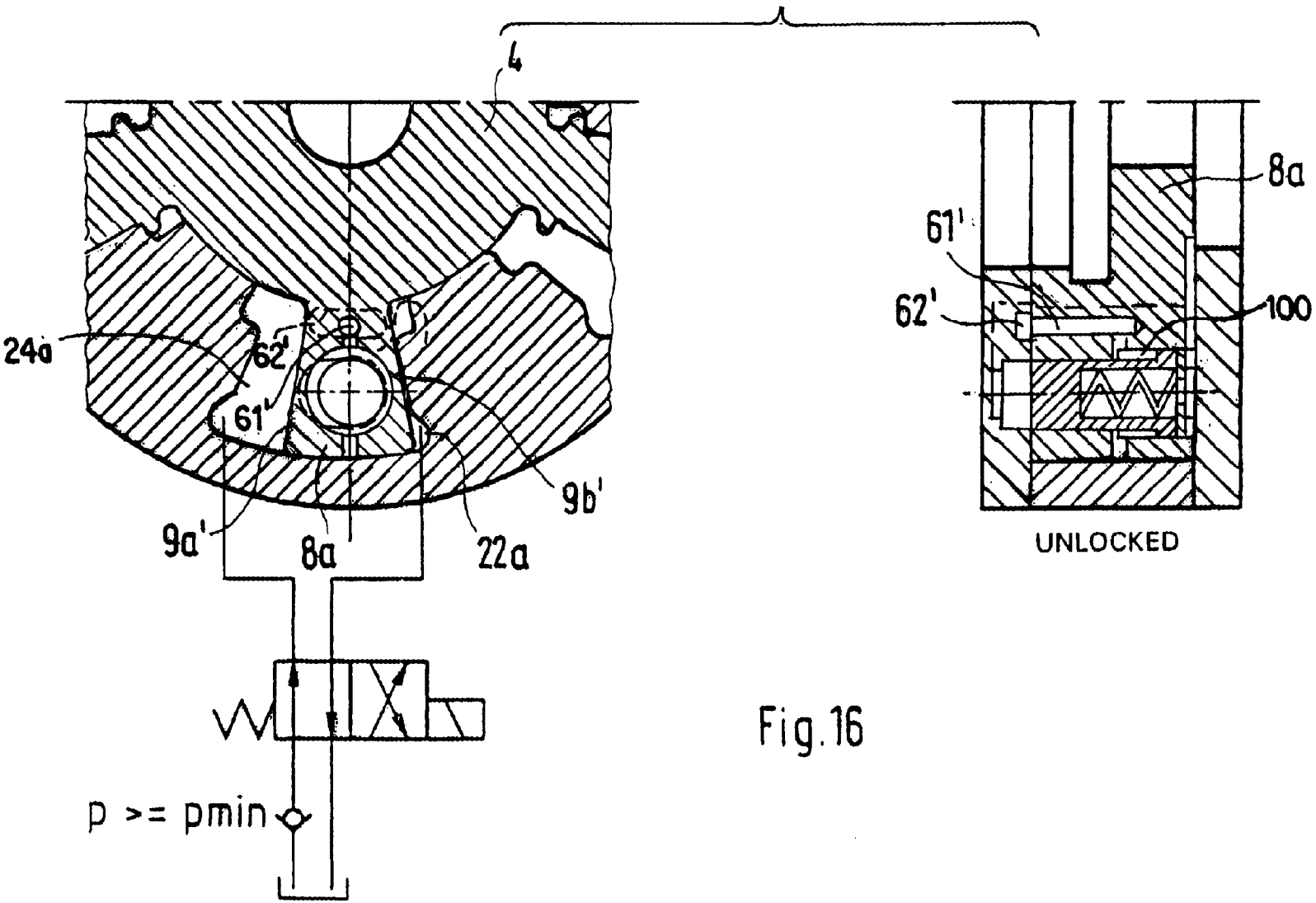
Figure 17:
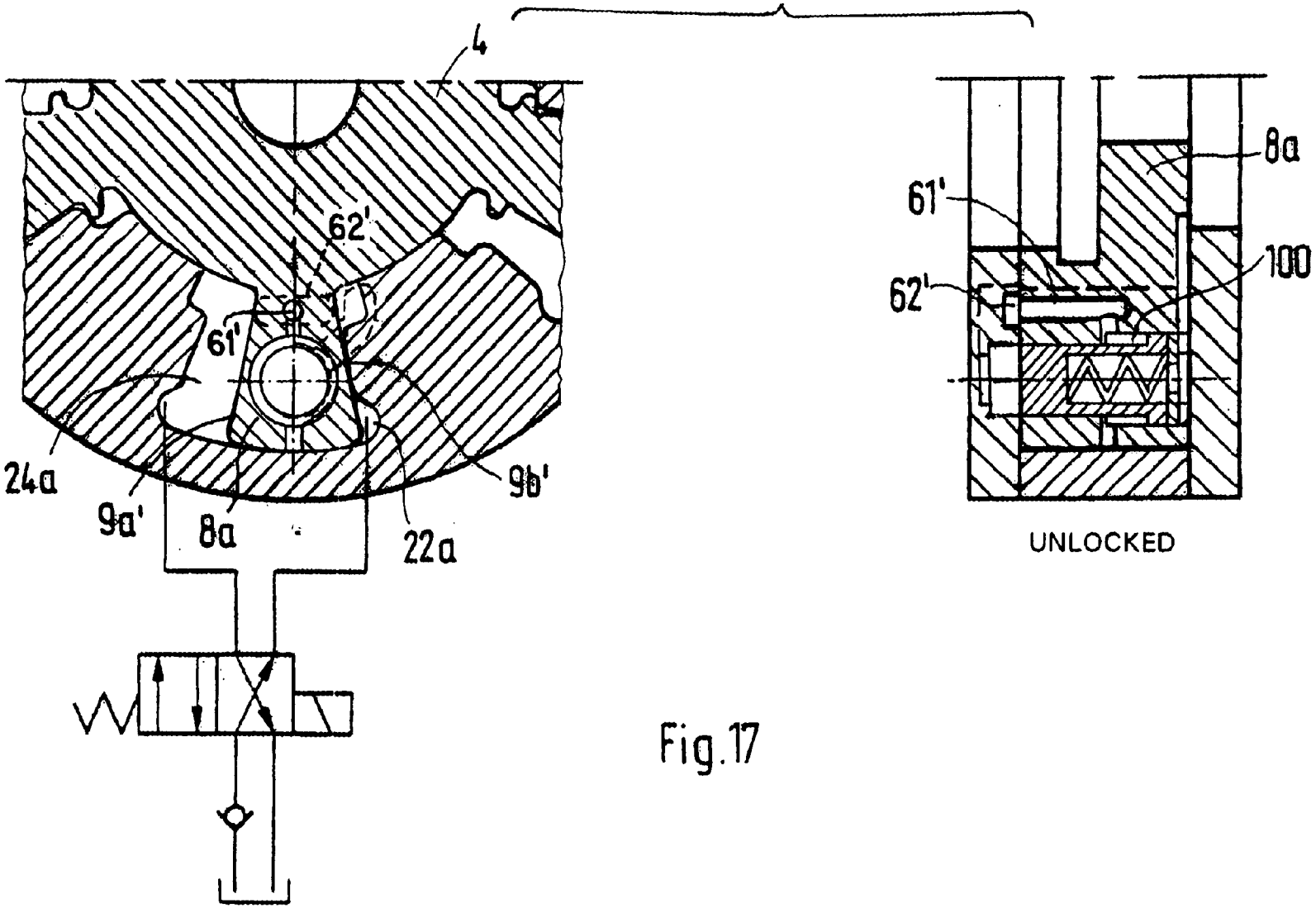
Figure 18:
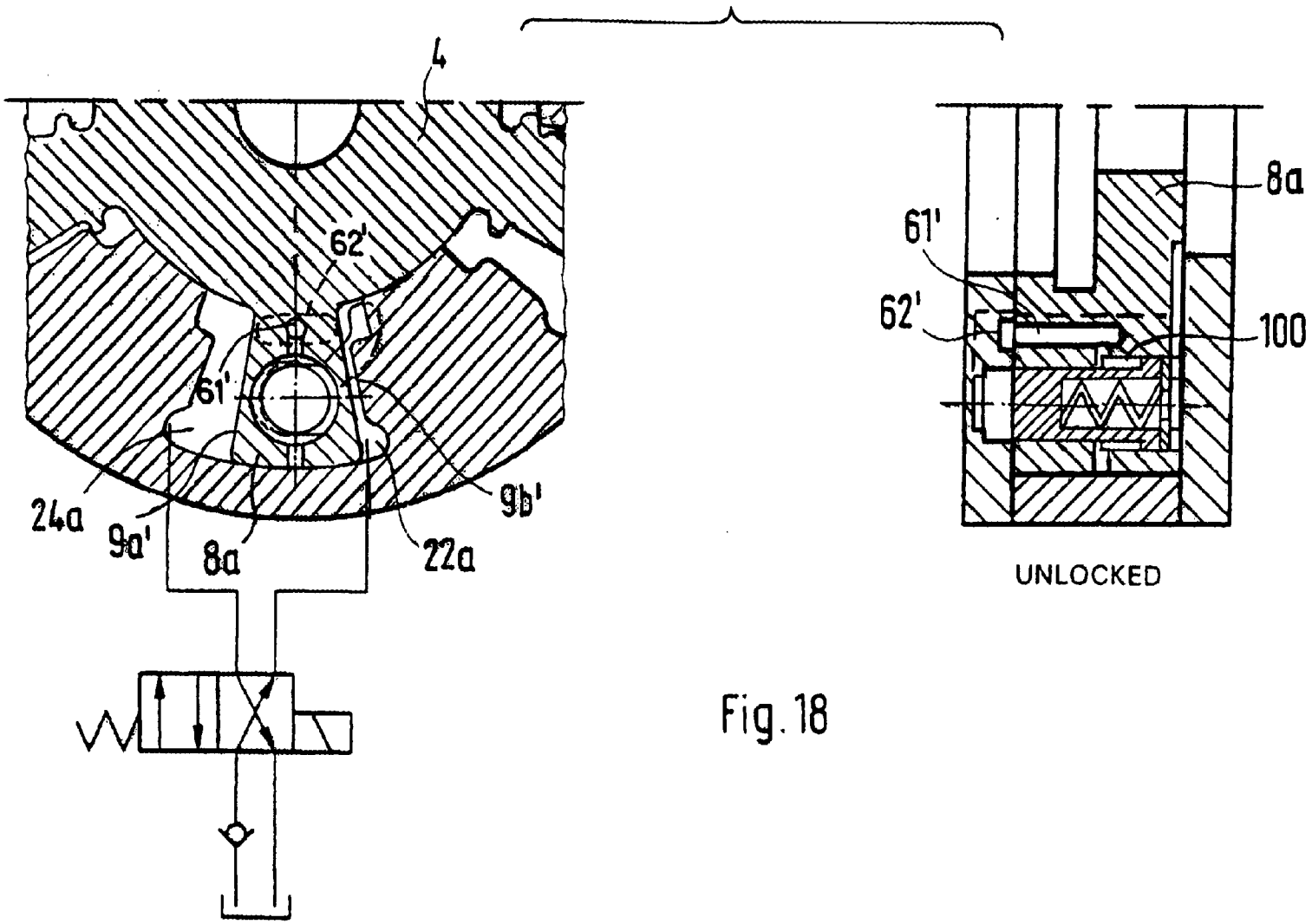
Figure 19:
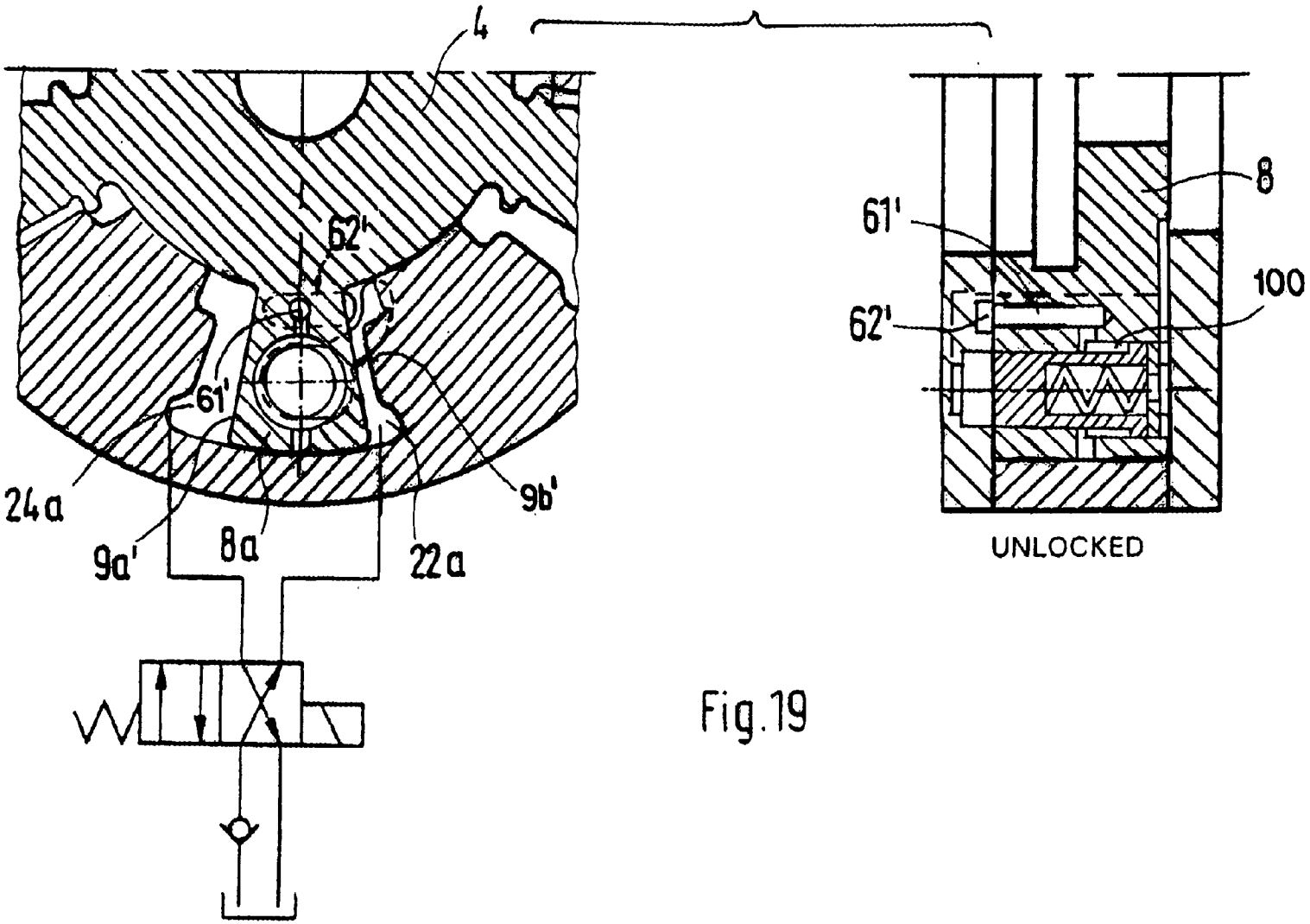
Figure 20:
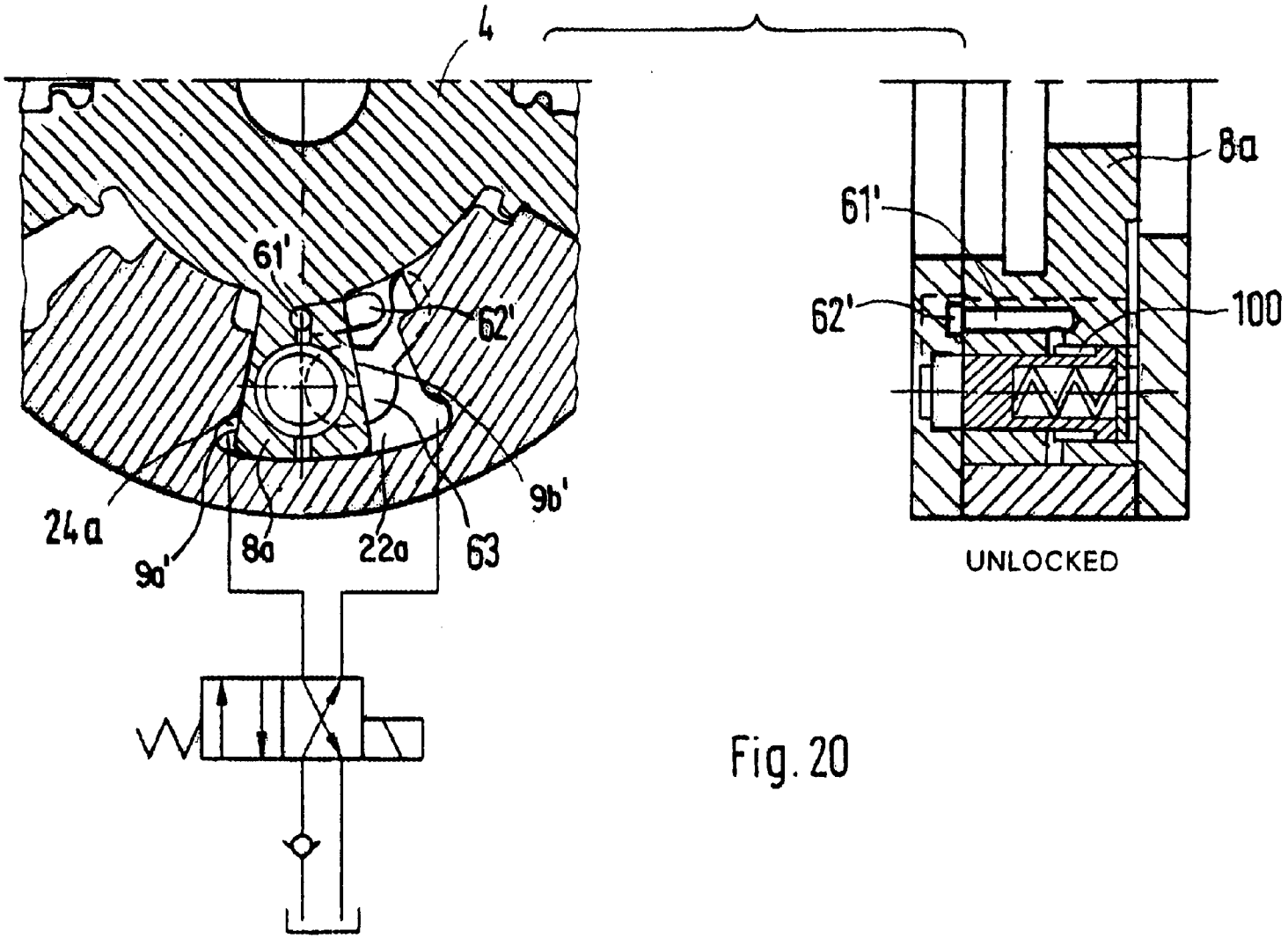
Figure 21:
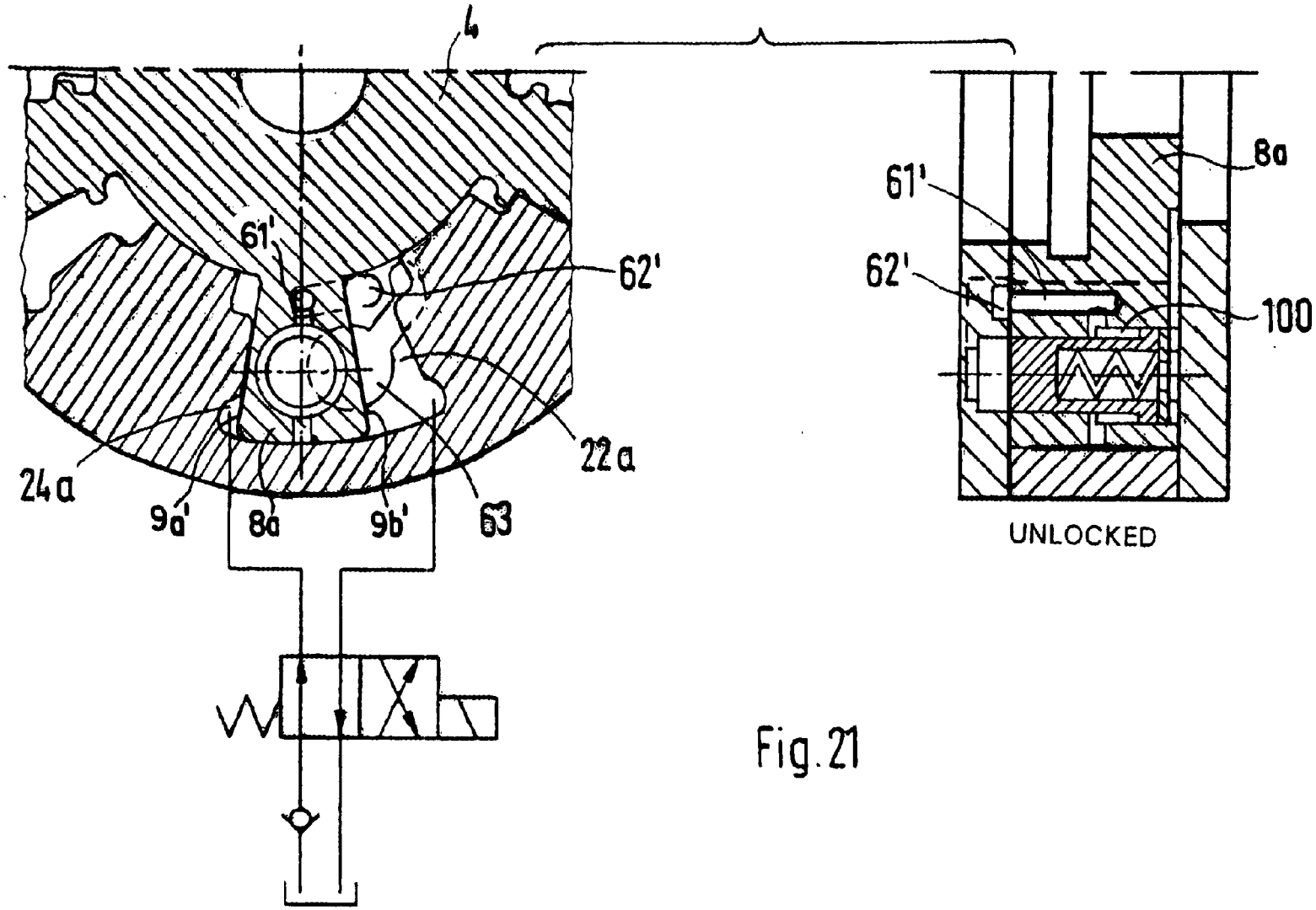
FIG. 21–FIG. 25 show various operations conditions of the adjusting unit in resetting direction based on a second embodiment.
Figure 22:
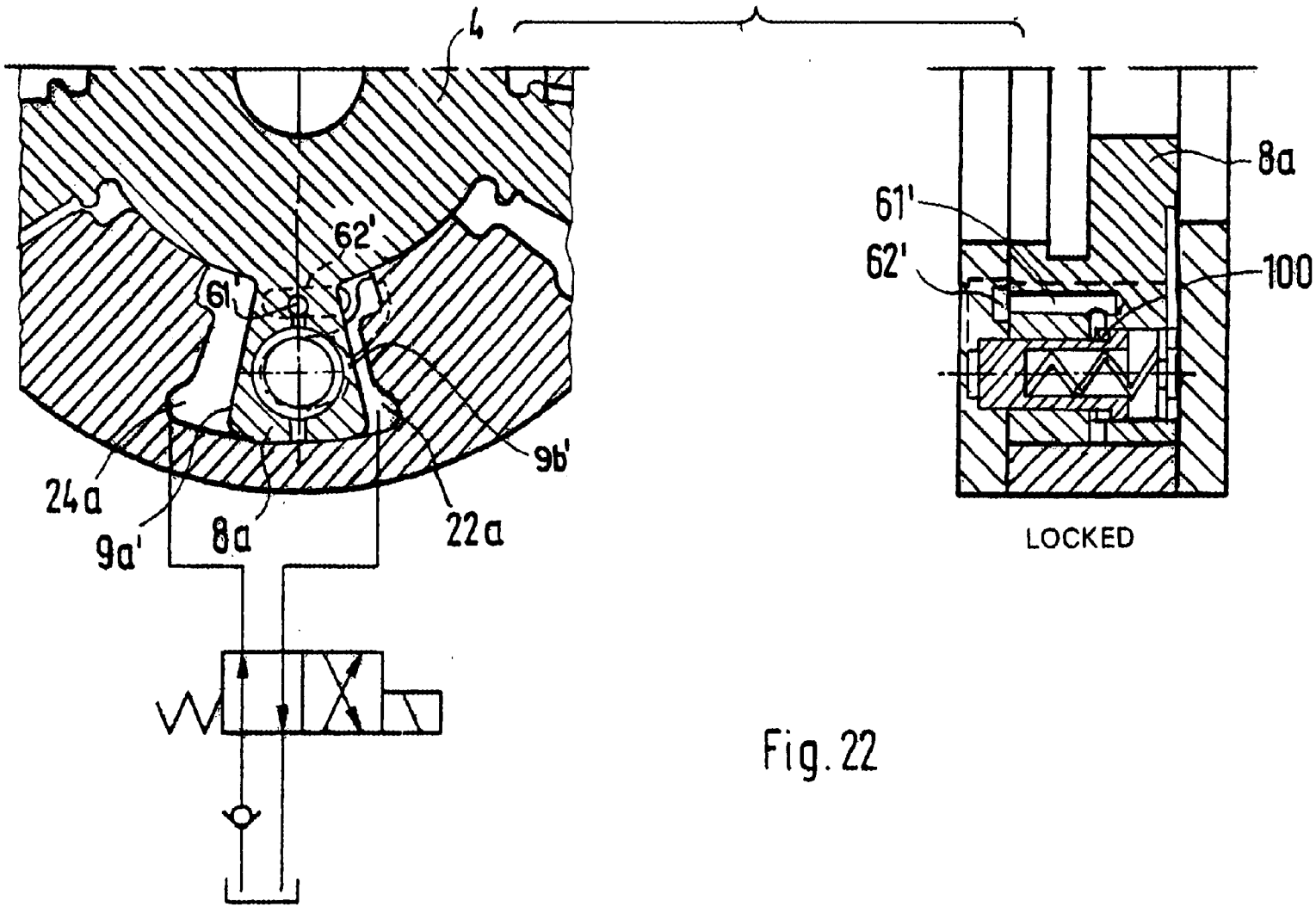
Figure 23:
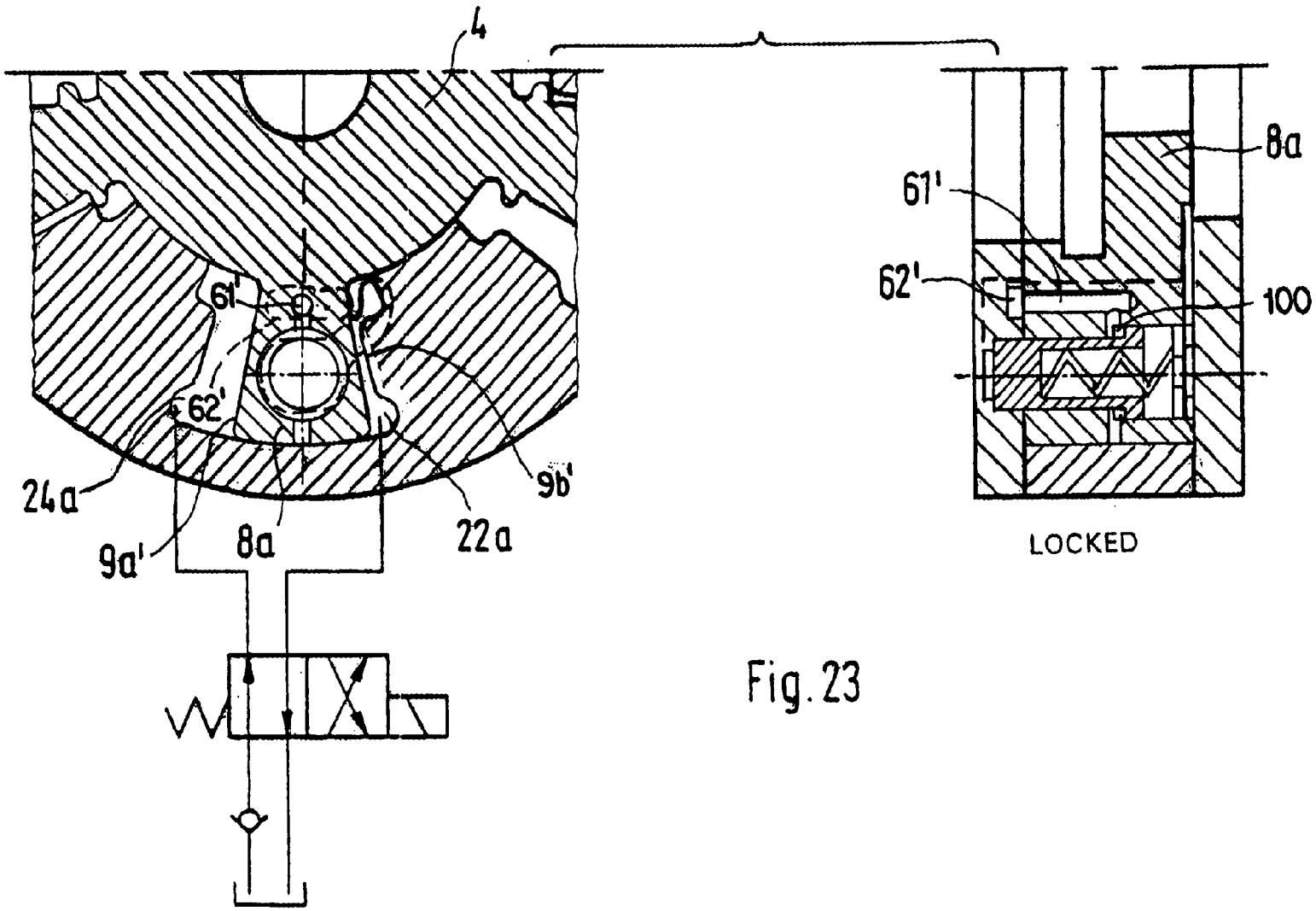
Figure 24:
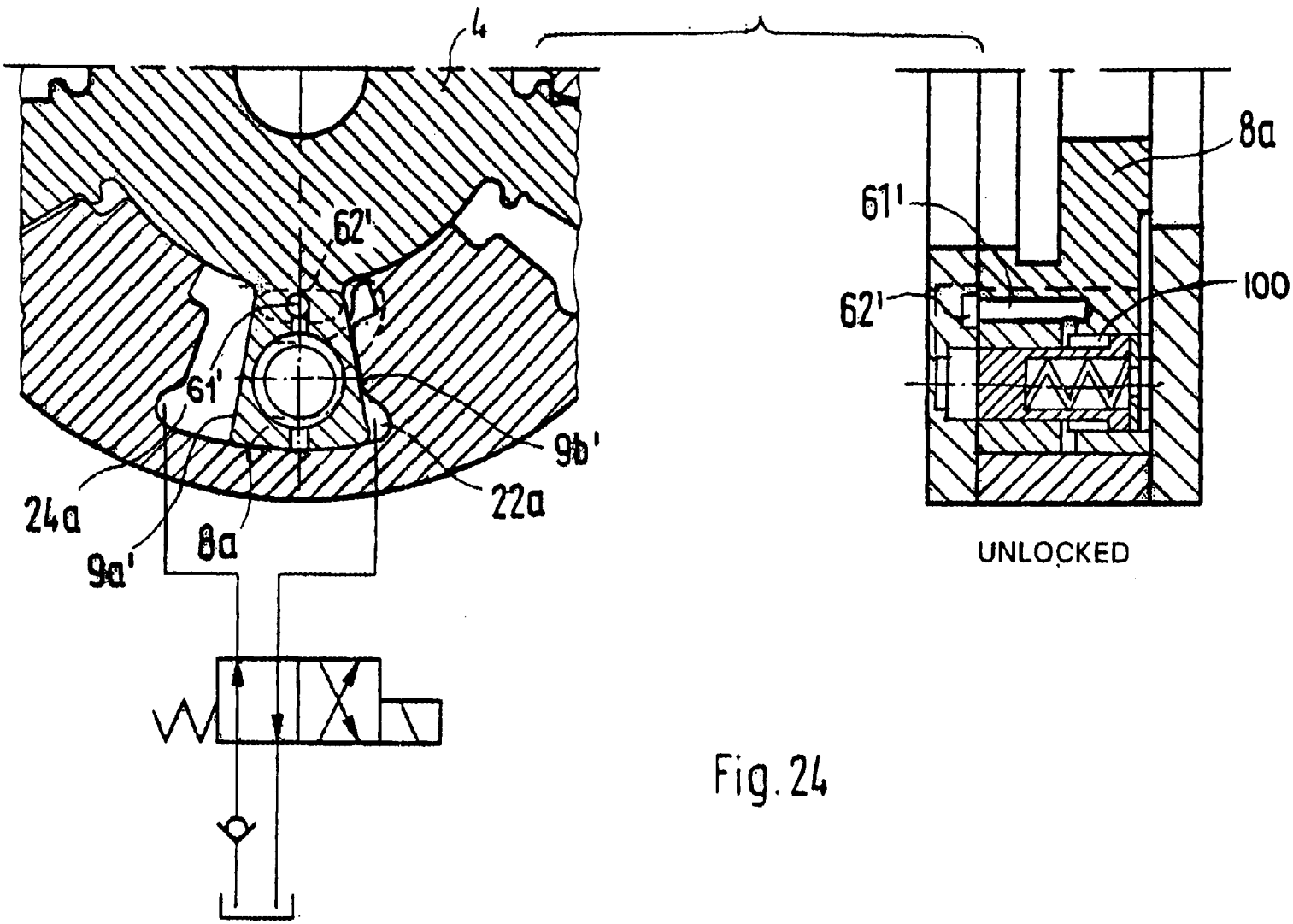
Figure 25:
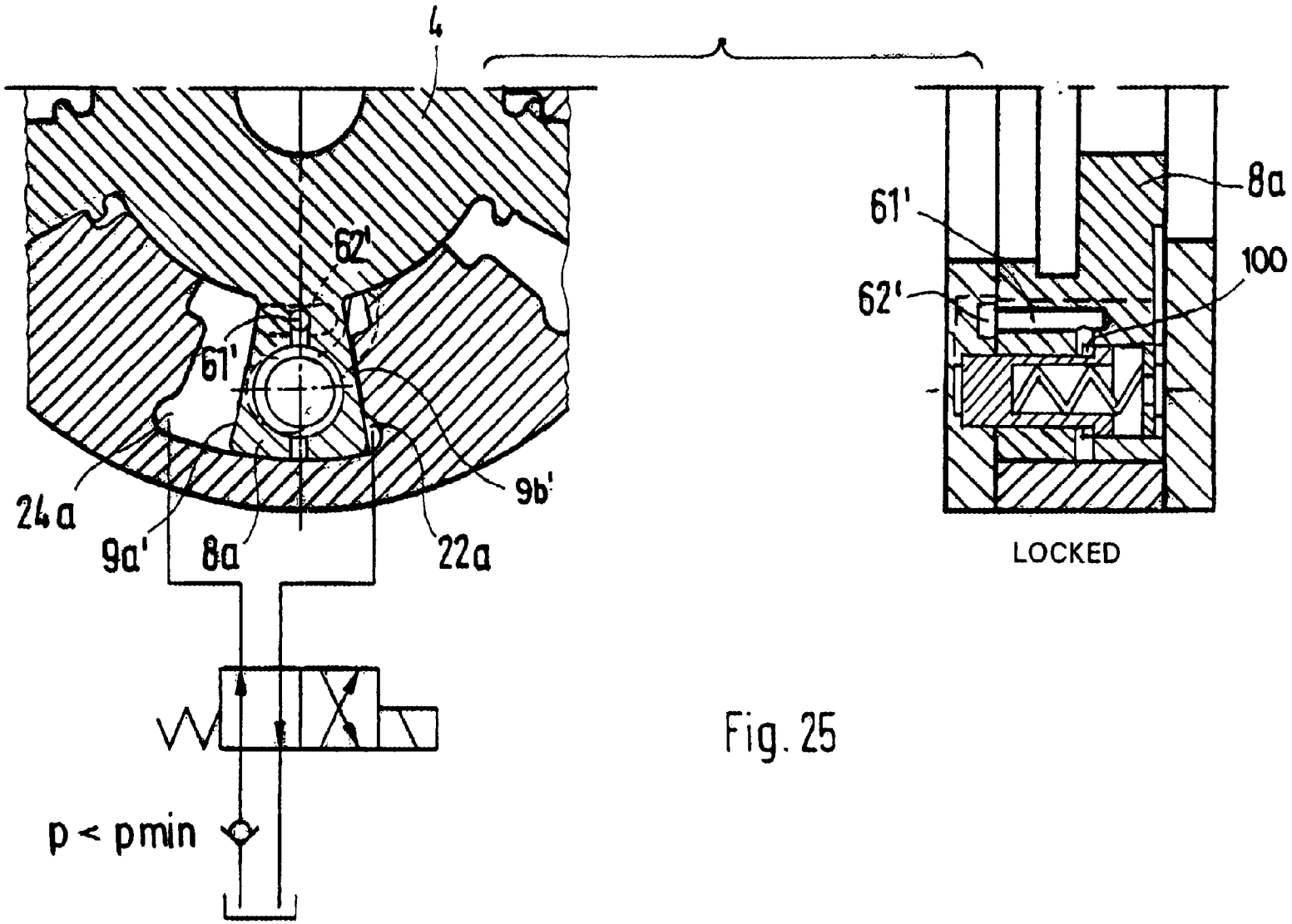

In order to be able to lock the interior part 4 opposite the cellular wheel 12 in a final position of the adjusting unit 6 as that shown in FIGS. 1–3, a bore 52 is provided in the rib 8*a* where a locking element, called a locking pin 53 in the following, is arranged. The bore 52 has the design of a step bore, wherein the part of the locking pin 53 that is equipped with a circular shoulder 55 is run in the larger bore section 54. The locking pin 53 is equipped with a bore 56, in which a pressure spring 57 is included that is arranged under tension between the bottom of the bore 56 and a plastic disk 58 that finds support on the disk 18 and is arranged in the bore section 54. The plastic disk 58 is equipped with a central opening 59, which is connected with a duct 60 that leads back to the tank 50 and through which leaking oil that is located in the bore 52 is guided back to the tank 50 when sliding the locking pin 53 against the spring resistance of the pressure spring 57. The duct 60 is formed by a groove that is arranged in the rib 8*a* and closed by the cover 18 except for one opening 46.

A radial through-bore 61 extends from the bottom area of the bore section 54 of the bore 52 to the front of the rib 8*a*. A pocket 62, which is designed as an opening and through which oil is fed into an annular chamber 100 that is formed by the circular shoulder 55, the interior wall of the bore 54 and the outer wall of the locking pin 53, which will be described in detail below, is integrated on the interior side of the cellular wheel 12 between the two ribs 14*a* and 14*e*. In the disk 16 a longitudinal bore 63 is integrated, in which the locking pin 53 can be locked into position. The longitudinal bore 63 extends in a circumferential direction so that in a rotational position of the interior part 4 that deviates only slightly from the final position of the adjusting device 6 the locking pin 53 can be locked. In the disk 16 a pocket hole 64 is arranged behind the longitudinal bore 63 and is connected with the longitudinal bore 63, with the diameter of this pocket hole 64 being smaller than the diameter of the locking pin 53. A duct 65, which is connected with the pressure chamber 22*a* and through which, as will be described in further detail below, oil pressure is applied on a front 66 of the locking pin 53 in certain operating states for the purpose of unlocking the locking pin 53, leads to the pocket hole 64.

A complete adjusting process of the adjusting device 6 of a certain preferred embodiment of the present invention is described in the following based on FIGS. 4–14.

FIG. 4

The internal combustion engine is shut off, i.e. in standstill mode. The locking pin 53 is in the locked position, i.e. it is locked by the pressure spring 57 in the bore 63 of the disk 16. Thus, the adjusting unit 6 is in its final position, which corresponds to an "early" opening and/or closing time of the exhaust valves of the internal combustion engine, which is actuated through cams and cam followers. During the starting process until idle speed has been reached, the engine oil pressure that is used for adjusting the interior part 4 compared to the cellular wheel 12 of the adjusting unit 6 remains below the minimal unlocking pressure level. The control valve 48 has no power, so oil is fed to the pressure chambers 24*a* through 24*e* through the control line A. In this rotational position of the interior part 4 relative to the cellular wheel 12, the left control edge 9*a* of the rib 8*a* releases the connection of the pressure chamber 24*a* to the pocket 62 so that oil can be fed through the bore 61 of the annular chamber 100, while the right control edge 9*b* of the rib 8*a* keeps the connection from the pressure chamber 22*a* to the pocket 62 closed.

FIG. 5

Next, the engine reaches idle speed. The control valve 48 continues to remain without power in its basic position. The hydraulic connection of the pressure chamber 24*a* to the annular chamber 100 remains open, while the rib 8*a* and/or the right control edge 9*b* keeps the pressure chamber 22*a* and the pocket 62 separate from each other. The engine oil pressure increases and exceeds the minimal unlocking pressure level, in which the locking pin 53 is guided into the unlocked position through its circular shoulder 55 against the spring resistance of the pressure spring 57 due to the oil pressure applied in the annular chamber 100.

FIG. 6

In the next step, the engine reaches an adjusting speed, at which the control valve 48 is provided with power; this provides oil supply through the control line B, which supplies the pressure chambers 22*a* through 22*e* with oil through the annular groove 34, the radial bores 32, the annular chamber 30 and the radial bores 28*a* through 28*e*. Since the passage of the pressure chamber 24*a* through the pocket 62 and the radial bore 61 to the annular chamber 100 continues to remain open, but pressurized oil supply occurs through the control line A to the annular chamber 100, the oil pressure that is applied in the annular chamber 100 drops. Nevertheless, the locking pin 53 remains in its unlocked position because at the same time oil is supplied to the front 66 of the locking pin 53 through the control line B, the duct 65 and the pocket hole 64. The hydraulic passage leading from the pressure chamber 22*a* through the pocket 62 and the radial bore 61 continues to remain closed. The interior part 4 of the adjusting unit 6 now moves one step toward the adjusting position, i.e. the ribs 8*a* through 8*e* of the interior part 4 lift off the ribs 14*a* through 14*e* of the cellular wheel 12.

Since in the final position the radial bores 28*b* through 28*e* still overlap completely with the ribs 14*a* through 14*d* (see FIG. 2), the pressure that is applied on the rotor at the beginning of the adjusting process occurs only through the pressure chamber 22*a*, to which pressurized oil is fed through the radial bore 28*a*, which is only partially covered by the rib 14*e*. This prevents an excessively rapid, uncontrolled initial adjusting movement.

FIG. 7

The interior part 4 moves one step toward the adjusting position, which causes the rib 8*a* to reach a position in which it closes the pocket 62 with its left and its right control edges 9*a* and 9*b* both from the direction of the pressure chamber 22*a* and from the direction of the pressure chamber 24*a* so that in this state no oil reaches either the annular chamber 100 or the pocket hole 64. Nevertheless, the locking pin 53 remains in its unlocked position because it experiences hydraulic tension and therefore no oil can escape through the pressure chambers 22*a* and 24*a*.

FIG. 8

The engine speed will increase further, the interior part of the adjusting unit 6 is moved another step toward the adjusting position due to the oil pressure supply to the pressure chambers 22*a* through 22*e*, wherein at the same time the pressure that is applied through the pressure chamber 22*a* to the front 66 of the locking pin 53 is maintained. With regard to the pocket 62, the rib 8*a* assumes a position in which the hydraulic passage to the annular chamber 100 through the pressure chamber 22*a* is released by the right control edge 9*b* of the rib 8*a* so that the unlocked position of the locking pin 53 is maintained. The hydraulic passage from the pressure chamber 24*a* to the annular chamber 100 is kept closed by the left control edge 9*a*.

FIG. 9

The engine has reached an adjusting speed, at which the maximal adjusting path is achieved while the ribs 8*a* through 8*e* of the interior part 4 rest against the ribs 14*a* through 14*e* of the cellular wheel 12.

FIG. 10

The engine speed is reduced, the control valve 48 no longer receives power, which causes it to return to its basic position, and the oil pressure supply occurs again to the pressure chambers 24*a* through 24*e* through the control line A. Although the hydraulic passage from the pressure chamber 22*a* to the pocket 62 is open, the transition area from the pocket 62 to the radial bore 61 that is arranged in the rib 8*a* however is not so that the oil pressure in the annular chamber 100 is maintained and the locking pin 53 remains in its unlocked position.

FIG. 11

The engine speed, and thus the adjusting speed, drops further, the interior part 4 of the adjusting unit 6 moves further toward the locking position due to the oil supply to the pressure chambers 24*a* through 24*e*. Since now the hydraulic passage from the pressure chamber 22*a* to the annular chamber 100 has been opened, the oil pressure in the annular chamber 100 is reduced through the pressure duct B to the tank 50. Since the rib 8*a* has reached a position where the locking pin 53 overlaps with the longitudinal bore 63, the locking pin 53 moves into its locked position.

FIG. 12

The engine speed drops further, the control valve 48 continues to remain without power in its basic position, and the interior part 4 of the adjusting unit 6 moves further toward its original locked final position. The hydraulic duct (pocket 62, bore 61) leading to the annular chamber 100 is closed both from the direction of the pressure chamber 22*a* and from the direction of the pressure chamber 24*a* due to the position of the rib 8*a*. Both the hydraulic duct leading to the annular chamber 100 and the duct 65 leading to the front 66 of the locking pin 53 have been relieved hydraulically. Thus, the locking pin 53 remains in its locking position.

FIG. 13

The interior part 4 of the adjusting unit 6 and thus the rib 8*a* that is equipped with the locking pin 53 moves further into the final position, wherein through the left control edge 9*a* the hydraulic duct that leads to the annular chamber 100 is released by opening up the connection between the pressure chamber 24*a* and the pocket 62. This way, oil pressure builds up in the annular chamber 100 so that the locking pin 53 is brought into the unlocked position.

By bringing the radial bores 28*b* through 28*a* back into a completely overlapping position with the ribs 14*a* through 14*d* of the cellular wheel 12 (see FIG. 2) immediately before the final position is reached, a final position dampening effect of the rotor is accomplished.

FIG. 14

The interior part 4 of the adjusting unit 6 has reached its final position, i.e. the ribs 8*a* through 8*e* of the interior part 4 again rest against the ribs 14*a* through 14*e* of the cellular wheel 12. The hydraulic passage from the pressure chamber 24*a* to the annular chamber 100 continues to remain open, while the hydraulic connection from the pressure chamber 22*a* to the annular chamber 100 is closed. When the engine oil pressure drops, e.g. when the engine is turned off, below the unlocking oil pressure level, the locking pin 53 is again safely returned into its locked position due to the spring resistance of the pressure spring 57. This ensures that in the case of a renewed start of the internal combustion engine a state is assumed in which the locking pin 53 is in its locked position.

Beyond that, the above-described adjusting and/or locking procedure can be applied particularly in the following operating states:

Idle Operation of the Internal Combustion Engine

During the idle state of the engine, the engine oil pressure drops with increasing oil temperature due to higher leakage loss and a higher pressure drop in the system. The oil pressure that is applied in the pressure chambers 24*a* is no longer sufficient for counter-acting the basic torque of the cam shaft as well as the alternating moments generated by the catching and/or trailing cams. When the engine is running at idle, as described above, oil is fed to the pressure chamber 24*a* and thus to the annular chamber 100 through the control line A. Since the engine oil pressure is larger than the minimal unlocking pressure level, the locking pin 53 is brought into its unlocked position pursuant to FIG. 5. Due to the above-described effects, the interior part 4 of the adjusting unit 6 can move in the adjusting direction, although at that time the pressure chambers 22*a* are not supplied with oil. The interior part 4 of the adjusting unit 6 however can only move up to the position shown in FIG. 8, which corresponds roughly to an adjusting angle of 1 to 1.5° since then the oil pressure supply through the pressure chamber 24*a* to the annular chamber 100 is closed off, while the oil pressure that is applied in the annular chamber 100 is reduced through the pressure chamber 22*a* and the control line B. Since in this position the locking pin 53 is still in the overlapping position with the longitudinal bore 63, the adjusting unit 6 is locked again and the interior part 4 moves again back to its final position. This ensures that despite the alternating moments of the cam shaft the interior part 4 of the adjusting unit 6 does not move into an undesirable adjusting position in an uncontrolled manner.

Turning Off the Internal Combustion Engine

When the engine is turned off, the interior part 4 is moved and/or pushed in the adjusting direction by the trailing moment of the cams. The control valve 48 is in its basic position without power. The movement of the interior part 4 in the adjusting direction additionally decreases the oil pressure in the pressure chamber 24*a*; the pressure chamber 24*a* however cannot be relieved hydraulically due to the return valve 51 that is arranged in the pressure line P. However, when the interior part 4 and/or the rib 8*a* reach the position as the one shown in FIG. 8 again, the annular chamber 100 is relieved hydraulically based on the above-described idle operation and the locking pin 53 is locked in the longitudinal bore 63 so that when the engine is restarted it is ensured that the adjusting unit 6 is in its locked final position.

A second embodiment of the invention depicted in FIGS. 15 through 25 only differs from the first one in its design, wherein the same reference numbers are used for similar components. Contrary to the first embodiment, the opening whose passage to the pressure chambers 22*a* and 24*a* is controlled in dependence of the adjusting position of the interior part 4 has the design of a longitudinal bore 62' that is arranged in the disk 16 and closed on both ends. The longitudinal bore 62' in turn is connected with a bore 61' that is arranged radially in the rib 8*a* and leads to the annular chamber 100. Similar to the first embodiment, the hydraulic through-flow from the pressure chamber 24*a* and/or 22*a* to the annular chamber 100 is controlled through the longitudinal bore 62' and the bore 61' in dependence of the rotational position of the interior part 4. The side areas of the ribs 8*a* in turn function as control edges 9*a*' and 9*b*'. The locking and adjusting states depicted in FIGS. 15 through 25 correspond to the states shown in FIGS. 4 through 14 of the first embodiment, wherein the description expressly refers to the first embodiment.

The device is also suited for adjusting an intake cam shaft; beyond that, the opening 62 and/or 62' can also be arranged in different locations of the stator of the adjusting unit 6.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A device for the relative rotational angle adjustment of a cam shaft of an internal combustion engine to a drive wheel, comprising:

an interior part which is connected in a stationary manner with the cam shaft and equipped with at least approximately radially running ribs or fins;

a driven cellular wheel, which is equipped with a plurality of cells being distributed around the circumference and limited by second ribs, each of the cells being divided into two pressure chambers by the ribs or fins of the interior part, which are guided in an articulating manner, the cam shaft being adjustable through the ribs or fins of the interior part between two final positions relative to the cellular wheel when hydraulic pressure is applied or relieved through control lines; and at least one locking device between the interior part and cellular wheel, being equipped with a movable locking element which acts together with at least one counter-element in one of the cellular wheel or the interior part, causing the interior part to be able to be locked relative to the cellular wheel in at least one of the final positions, wherein, one of a locking or unlocking process of the locking element operatively occurs through at least one oil duct which leads to the locking element; and wherein between the two pressure chambers of one of the cells, in or on the cellular wheel, an opening, which is connected with the oil duct, is arranged, whereby a passage to the two pressure chambers of the one of the cells is controlled in dependence of an adjusting position of the interior part.

2. A device according to claim 1, wherein the opening is partially or completely covered by one of the ribs of the interior part in dependence of the adjusting position, and a bore is arranged in the one of the ribs for holding a locking pin.

3. A device according to claim 2, wherein the opening is arranged on a radially inner side of the cellular wheel, and an oil bore is provided on a radially outer side of the one of the ribs, which communicates with the opening in dependence of a rotational position of the interior part.

4. A device according to claim 2, wherein the opening is arranged in a cover which closes one side of the cellular wheel, and wherein an oil bore is provided in a bottom area of one of the ribs, which communicates with the opening in dependence of a rotational position of the interior part.

5. A device according to claim 1, wherein the opening is arranged on a radially inner side of the cellular wheel, and an oil bore is provided on a radially outer side of one of the ribs, which communicates with the opening in dependence of a rotational position of the interior part.

6. A device according to claim 5, wherein the oil bore leads to an annular chamber, by which the locking pin can be unlocked.

7. A device according to claim 6, wherein oil supply to the annular chamber occurs through one of the pressure chambers.

8. A device according to claim 7, wherein a longitudinal bore, which holds the locking pin in a locked position, is arranged in a disk that closes off the cellular wheel.

9. A device according to claim 6, wherein a longitudinal bore, which holds the locking pin in a locked position, is arranged in a disk that closes off the cellular wheel.

10. A device according to claim 5, wherein a longitudinal bore, which holds the locking pin in a locked position, is arranged in a disk that closes off the cellular wheel.

11. A device according to claim 1, wherein the opening is arranged in a cover which closes one side of the cellular wheel, and wherein an oil bore is provided in a bottom area of the rib, which communicates with the opening in dependence of a rotational position of the interior part.

12. A device according to claim 11, wherein the bore leads to an annular chamber, by which the locking pin can be unlocked.

13. A device according to claim 12, wherein oil supply to the annular chamber occurs through one of the pressure chambers.

14. A device according to claim 12, wherein a longitudinal bore, which holds the locking pin in a locked position, is arranged in a disk that closes off the cellular wheel.

15. A device according to claim 11, wherein a longitudinal bore, which holds the locking pin in a locked position, is arranged in a disk that closes off the cellular wheel.

16. A device according to claim 1, wherein a longitudinal bore, which holds the locking pin in a locked position, is arranged in a disk that closes off the cellular wheel.

17. A device according to claim 16, wherein an oil duct leads to the longitudinal bore so that the locking pin can be unlocked from a front side.

18. A device according to claim 17, wherein to the front side of the locking pin oil pressure is applied through a control line, one of the pressure chambers and the oil duct.

19. A method of making a relative rotational angle adjuster of a cam shaft of an engine to a drive wheel, comprising:

connecting an interior part having at least approximately radial ribs to the cam shaft in a stationary manner;

providing a driven cellular wheel having a plurality of cells distributed circumferentially and limited by second ribs;

dividing each of the cells into two pressure chambers by the ribs of the interior part which are guided in an articulating manner so that the cam shaft is adjustable via the ribs of the interior part between two final positions relative to the cellular wheel when hydraulic pressure is applied or relived through control lines;

providing between the interior part and the cellular wheel at least one locking device having a movable locking element which acts with at least one counter-element in one of the cellular wheel or the interior part to operatively cause the interior part to be locked relative to the cellular wheel in at least one of the final positions;

providing at least one oil duct leading to the locking element to operatively provide locking or unlocking of the locking element; and connecting the oil duct to an opening in or on the cellular wheel between the two respective pressure chambers whereby a passage to the two respective pressure chambers is operatively controlled depending on an adjusting position of the interior part.

20. A driven cellular wheel assembly for the relative rotational angle adjustment of a cam shaft of an engine to a drive wheel, comprising:

a driven cellular wheel having a plurality of cells arranged around a circumference;

approximately radial ribs limiting the cells;

articulatingly guided ribs dividing each respective cell into two respective pressure chambers which operatively adjust the cam shaft relative to the cellular wheel via hydraulic pressure;

at least one locking device having a movable locking element which acts with at least one counter-element to lock the guided ribs relative to the cellular wheel in at least one position;

at least one oil duct leading to the locking element to operatively lock or unlock the locking element; and an opening being arranged in or on the cellular wheel between two of the respective pressure chambers and connected to the oil duct whereby a passage is operatively formed between one of the respective pressure chambers and the oil duct depending on an adjusting position of the respective guided rib.

* * * * *